US005833545A

United States Patent [19]

Pinch et al.

[11] Patent Number: 5,833,545

[45] Date of Patent: Nov. 10, 1998

[54] AUTOMATIC PENDULUM-DRIVE SYSTEM

[75] Inventors: Daniel R. Pinch, Columbus; Dennis M. Turner, Scipio, both of Ind.

[73] Assignee: Cosco, Inc., Columbus, Ind.

[21] Appl. No.: 704,277

[22] Filed: Aug. 28, 1996

[51] Int. Cl.[6] ..... A63G 9/16

[52] U.S. Cl. ..... 472/119; 297/273

[58] Field of Search ..... 472/118, 119, 472/125; 297/273, 274, 275, 276, 277, 281, 260; 5/108, 109

[56] References Cited

U.S. PATENT DOCUMENTS

| | | |
|---|---|---|
| 989,517 | 4/1911 | Turmelle . |
| 1,016,712 | 2/1912 | Schilling . |
| 1,505,117 | 8/1924 | Withun . |
| 1,702,190 | 2/1929 | Anello . |
| 2,024,855 | 12/1935 | Goetter . |
| 2,091,841 | 8/1937 | Warren . |
| 2,564,547 | 8/1951 | Schrougham . |
| 2,609,031 | 9/1952 | Puscas . |
| 2,617,247 | 11/1952 | Punzak . |
| 2,972,152 | 2/1961 | Vincent . |
| 3,146,985 | 9/1964 | Grudoski . |
| 3,290,874 | 12/1966 | Koplar . |
| 3,417,498 | 12/1968 | Anthony . |
| 3,434,279 | 3/1969 | Hancock et al. . |
| 3,486,321 | 12/1969 | Bodet . |
| 3,692,305 | 9/1972 | Allen . |
| 3,802,181 | 4/1974 | Marquis . |
| 3,842,450 | 10/1974 | Pad . |
| 3,883,136 | 5/1975 | Kim . |
| 4,150,820 | 4/1979 | Bochmann . |
| 4,211,401 | 7/1980 | Cunard . |
| 4,448,410 | 5/1984 | Kosoff . |
| 4,452,446 | 6/1984 | Saint . |
| 4,491,317 | 1/1985 | Bansal . |
| 4,616,824 | 10/1986 | Quinlan, Jr. et al. . |
| 4,722,521 | 2/1988 | Hyde et al. . |
| 4,785,678 | 11/1988 | McGugan et al. . |
| 4,807,872 | 2/1989 | Spilman et al. . |
| 4,822,033 | 4/1989 | Kohus et al. . |
| 4,911,429 | 3/1990 | Ogbu . |
| 5,085,425 | 2/1992 | Collins et al. . |
| 5,139,462 | 8/1992 | Gabe . |
| 5,326,327 | 7/1994 | Stephens et al. . |
| 5,378,196 | 1/1995 | Pinch et al. . |

*Primary Examiner*—Kien T. Nguyen
*Attorney, Agent, or Firm*—Barnes & Thornburg

[57] ABSTRACT

A swing includes a swing motor and an adaptive control system for periodically actuating the swing motor to sustain swinging pendulum movement of a seat along a swing arc in a manner that is compatible with the natural frequency (and period) of the seat. The swing further includes a support stand and a swing seat frame mounted on the support stand to carry the seat. The adaptive control system includes an impulse mechanism that applies a torque to the swing seat frame and that is actuated at a variable point along the swing arc between first and second extreme positions and without regard to the position of the swing seat frame relative to the support stand.

57 Claims, 15 Drawing Sheets

AUTOMATIC PENDULUM-DRIVE SYSTEM

BACKGROUND AND SUMMARY OF THE INVENTION

The present invention relates to an automatic pendulum-drive system, and particularly to a swing having a swing motor and an adaptive control system for periodically actuating the swing motor to sustain swinging pendulum movement of a seat along a swing arc in a manner that is compatible with the natural frequency (and period) of the seat. More particularly, the present invention relates to a swing having an electric swing motor supported on a sturdy frame and operated periodically to swing a seat suspended from the frame.

Any rigid body mounted so that it can swing in a vertical plane about some axis passing through it under the influence of gravity is called a physical pendulum. A swing seat mounted on a frame for swinging movement about a swing axis is an example of a physical pendulum because the swing seat can swing backward and forward along a swing arc like a pendulum in a grandfather's clock.

Pendulums such as clock bobs and swing seats swing along a swing arc back and forth between first and second extreme positions. "Amplitude" is understood to be the extent of angular movement of a pendulum measured from the first extreme position to the second extreme position.

The motion of a pendulum is periodic and oscillatory. Any motion that repeats itself in equal intervals of time is called periodic motion. A body in periodic motion that moves back and forth over the same path undergoes oscillatory motion. The "period" of motion of a pendulum is understood to be the interval of time required for the pendulum to complete a cycle and begin to repeat itself. A cycle is one complete round trip of motion (e.g., swinging movement of a pendulum from the first extreme position to the second extreme position and back to the first extreme position).

The period of any pendulum is a function of (1) gravity; (2) the distance between the center of gravity of the pendulum and the axis about which the pendulum swings; and (3) the amplitude of the pendulum (especially in circumstances where the pendulum amplitude is greater than a few degrees). The period of a pendulum is typically measured in seconds per cycle. It is important to understand that the period of a pendulum is independent of the mass of the pendulum.

The natural frequency of a pendulum is the number of cycles completed by the pendulum per unit time when the pendulum is displaced and then released. The natural frequency of a pendulum is also a function of the three factors noted above in the discussion about the period of a pendulum. The natural frequency of a pendulum is independent of the mass of the pendulum and is typically measured in cycles per second.

A pendulum would oscillate indefinitely if no frictional or wind-resistance forces acted on the pendulum. Actually, the amplitude of oscillation of a pendulum gradually decreases to zero as a result of friction and wind-resistance forces acting on the pendulum as it swings unless some oscillatory external force is applied to the pendulum. In some cases, in an attempt to sustain swinging movement of a pendulum, the pendulum is subjected to an oscillatory external force having a frequency that is different than the natural frequency of the pendulum. The response of the pendulum depends on the relation between the "forced" and natural frequency.

Various kinds of swing motors have been employed to sustain swinging movement of a pendulum such as a clock bob or a swing seat at a selected amplitude. Grandfather's clocks commonly include wind-up spring motors and electric clocks commonly include electric motors for this purpose. Child swings commonly include either wind-up spring motors or electric swing motors that operate to sustain swing movement of the swing seat.

It is known to use an electric motor to drive a clock pendulum, mobile display drive mechanism, or a novelty swing. See, for example, U.S. Pat. Nos. 3,802,181; 3,486,321; 3,434,279; 3,417,498; 3,290,844; 2,617,247; and 2,091,841.

It is also known to use other electromagnetic means to drive a swing or pendulum. See, for example, U.S. Pat. Nos. 4,616,824; 4,491,317; 3,883,136; and 3,842,450.

Electric motor-driven swings are also well known. See, for example, U.S. Pat. Nos. 5,326,327; 5,139,462; 4,911,429; 4,822,033; 4,807,872; 4,785,678; 4,722,521; 4,452,446; 4,421,401; and 4,150,820. See also U.S. Pat. Nos. 3,692,305; 3,146,985; 2,972,152; 2,609,031; 2,564,547; 2,024,855; 1,702,190; 1,505,117; and 1,016,712. An automatic lawn swing including an electric motor was patented as early as 1911 in U.S. Pat. No. 989,517.

One problem with some conventional child swings is that the frequency of the oscillatory external force applied to sustain swinging movement of the child swing is significantly different, at least at the beginning of swinging motion, from the natural frequency of the swing. The periodic application of such an "unmatched" external force to a swinging child swing can tend to impair swinging movement of the child swing rather than to enhance it. This problem can affect the operation of child swings having either wind-up spring motors or electric swing motors.

It is difficult for a child swing manufacturer to know in advance (at the child swing design stage) what the natural frequency (and period) of the child seat included in its child swing will be at the time it is swung because the natural frequency (and period) of the child seat is a function of three variable factors as noted above. Again, these factors as applied to child swings are gravity, the distance between the center of gravity of the child seat and the axis through the swing frame about which the child seat swings, and the amplitude of the child seat (especially in circumstances where the child seat amplitude is greater than a few degrees and is about 50°). As a result of such difficulties, swing driving systems in many child swings, especially child swings driven by electric swing motors, fail to apply an external force that "picks up" on or is compatible with the natural frequency of the swinging child seat. Several examples of factors causing a post-manufacture change in the natural frequency of a child seat are set forth below.

A first factor is gravity. The natural frequency (and period) of a child swing seat will vary at different elevations above seat level due to gravity changes. One child swing seat will have one natural frequency if used at the seashore and another natural frequency if used at a spot high in the mountains.

A second factor is center of gravity location. The natural frequency (and period) of a child swing seat containing a child will differ from the natural frequency of the same seat when empty because of a difference in the distance of the center of gravity of the two systems just mentioned from the axis of rotation of the child swing seat. Also, the natural frequency (and period) of a seat containing a child can vary (1) each time the child moves about in the seat, (2) each time a new child is seated in the seat, and (3) each time the seat back is adjusted to change the position of the child between, for example, a vertical sitting position, an angled reclining position, or a horizontal laying-down position because the distance of the center of gravity of the seat and the child from the axis of rotation of the child swing will have been changed somewhat.

A third factor is amplitude. The natural frequency (and period) of a child swing seat that is pulled back by a user to a point along its swing arc that is 30° from its equilibrium position (i.e., the position the seat has when it is hanging at rest) and then released will be different than the natural frequency (and period) of the same child swing seat that is pulled back by the user to a point along its swing arc that is 5° from its equilibrium position.

Many conventional child swings are unable to cause their swing-drive systems to adapt to variations in the natural frequency (and period) of a child seat and, as such, fail to sustain swinging movement of the child seat efficiently and effectively. See, however, disclosures in U.S. Pat. No. 5,378,196 to Pinch and Turner and U.S. Pat. No. 4,722,521 to Hyde et al. In the Pinch and Turner '196 patent, an external swing-driving force is applied at an extreme position of the child swing. In the Hyde et al. '521 patent, an external swing-driving force is applied at an actuation position that is fixed with respect to the frame supporting the child swing.

What is needed is a "timed" pendulum-drive system that is operable to sustain swinging movement of a pendulum by applying a torque to the pendulum at the right moment, for a prescribed duration, or both, during a swinging cycle in a manner that is in tune and compatible with the natural frequency of the pendulum so that the pendulum is subjected to a swing motion-enhancing angular impulse as it swings along the swing arc. An improved child swing having such a timed pendulum-drive system would operate efficiently and effectively to sustain swinging movement of a child swing seat regardless of the natural frequency (or period) of the child swing seat and a child seated or moving about therein. Parents and other caregivers would welcome an electric motor-driven child swing provided with such a timed pendulum-drive mechanism.

According to the present invention, an automatic pendulum-drive system is provided to sustain swinging movement of a pendulum about an axis of rotation in a manner that is compatible with the natural frequency and period of the pendulum. A pendulum-drive system in accordance with the present invention is applicable to pendulums and any body such as, for example, a swing that acts like a pendulum and oscillates about an axis of rotation.

According to a preferred embodiment of the invention, a swing includes a support stand and a swing seat frame mounted on the support stand to swing freely back and forth along a swing arc about an axis of rotation between first and second extreme positions. The swing further includes impulse means for applying a torque to the swing seat frame for a predetermined time interval. Thus, the swing seat frame is subjected to an angular impulse (i.e., a torque acting on a body for a very short interval of time) as it swings along the swing arc to sustain swinging movement of the swing frame back and forth along the swing arc.

Means is provided in the swing for actuating the impulse means at an actuation position of the swing seat frame located along the swing arc between the first and second extreme positions so that the actuation position is not fixed relative to the support stand. The impulse means is thus actuated following free swinging movement of the swing seat frame from the first extreme position toward the second extreme position as soon as the swing seat frame reaches the actuation position regardless of the position of the swing seat frame relative to the support stand. Once actuated, the impulse means applies torque to the swing seat frame for the predetermined time interval during swinging movement of the swing seat frame from the actuation position toward the second extreme position.

In preferred embodiments, the actuating means is configured to actuate the impulse means in response to angular movement of the swing seat frame along the swing arc from the first extreme position through a predetermined angle to the actuation position. The actuating means effectively sets the actuation position at a "variable" point along the swing arc that is aligned in a fixed angular relation to the first extreme position and that is not fixed relative to the support stand. The variable point is so named because its location along the swing arc and relative to the support stand can change following each swing cycle since the location is a function of angular movement of the swing seat frame relative to the first extreme position of the swing seat frame and the location of the first extreme position of the swing seat frame is a function of the natural frequency of the swing seat frame. This causes the impulse means to be actuated in response to certain angular displacement of the swing seat frame from the first extreme position without regard to the position of the swing seat frame relative to the support stand.

Any change in the natural frequency of the swing seat frame will change the location of the first extreme position along the swing arc. The actuating means in accordance with the present invention adapts automatically to the natural frequency of the swing seat frame without any intervention or adjustment by a parent or caregiver because it actuates the impulse means following predetermined angular displacement of the swing seat frame from the first extreme position regardless of the location of the first extreme position along the swing arc and regardless of the position of the swing seat frame relative to its equilibrium position and to the support stand. A swing in accordance with the present invention has a motorized drive system that is well-suited to drive a swing seat that is empty, contains light or heavy children, or contains stationary or moving children since all of those variables function to change the natural frequency of the seat and the swing is automatically adaptable to a seat regardless of the natural frequency of the seat.

The swing seat frame includes a drive shaft supported on the support stand for rotation about an axis of rotation and a swing seat coupled to the drive shaft to rotate therewith. The impulse means includes an electric swing motor and a torque-transmission linkage. The torque-transmission linkage includes a nylon drive line and is coupled to the electric swing motor and to the drive shaft and configured so that the motor can move the linkage to turn the drive shaft and swing the swing seat.

The actuating means includes an impulse-start switch and an electrical circuit coupled to the electric swing motor and to the impulse-start switch. The impulse-start switch includes an electrically conductive slip ring configured to wrap around the drive shaft and establish a slippable friction fit therewith and a switch arm appended to the slip arm and arranged to move therewith. The electrical circuit includes a power supply and an impulse-start contact arranged to be engaged by the switch arm in response to movement of the slip ring with the rotating drive shaft during angular movement of the swing seat frame from the first extreme position through the predetermined angle to the actuation position. The electrical circuit is completed using the electrically conductive slip switch to actuate the electric swing motor upon engagement of the switch arm and the impulse-start contact.

The impulse means further includes a timer for allowing the electric swing motor to remain in a motor-on condition for the predetermined time interval as the swing seat frame swings from the actuation position toward the second extreme position. This causes torque to be applied to the drive shaft of the swing seat frame by the torque-transmission means coupled to the electric swing motor for a predetermined amount of time so that the swing seat frame is subjected to an angular impulse or "tap" as it swings from the actuation position toward the second extreme condition.

The timer is configured to turn off power to the electric swing motor before the swing seat frame reaches the second extreme position. As the swing seat frame changes swing direction and swings freely from the second extreme position toward the first extreme position, the timer is reset for use during the next cycle.

In use, the swing seat frame and seat begin to swing in the following ways. A user first pulls (or pushes) the seat along the swing arc and then releases it. In some embodiments, a swing in accordance with the present invention is self-starting in that movement of a child in the seat is enough to cause the swing to begin swinging and the impulse means and actuating means function to sustain swinging movement of the swing. Once the swinging seat reaches (by any means) the first extreme position, a new swing cycle begins.

At the beginning of each cycle, the seat is located at the first extreme position and power to the electric swing motor is off. The seat then swings freely along the swing arc from the first extreme position in a direction toward the second extreme position through a predetermined angle (e.g., about 5°) to the actuation position. At the same time, the impulse-start switch rotates with the drive shaft about the axis of rotation in a direction toward an impulse-start contact in the electrical circuit. As soon as the seat reaches the actuation position, a portion of the impulse-start switch engages the impulse-start contact in the electrical circuit to complete the circuit and start the electric swing motor and timer running. Once the motor starts, an angular impulse generated by the motor and timer and transmitted to the drive shaft causes the seat to be driven along the swing arc in the direction toward the second extreme position for a predetermined time interval until the timer shuts off the flow of electrical current to the motor. Then, the seat swings freely in the same direction along the swing arc until it reaches the second extreme position. After the seat has "peaked" at the second extreme position, it swings freely in the other direction along the swing arc until it reaches and peaks at the first extreme position. The next swing cycle then begins. The timer is reset automatically as the seat swings freely from the second extreme position to the first extreme position. The seat is swinging freely each time it reaches the first and second extreme positions.

A swing in accordance with the present invention includes an electric drive motor that is pulsed by a timer and that does not run continuously during each swing cycle. The swing includes a motor-actuation system that picks up on and is compatible with the natural frequency of the swing seat. The swing motor is not driving the swing seat at either one of the first and second extreme positions of the swing seat along its swing arc. The swing motor is not actuated when the swing seat reaches a fixed position on the swing arc relative to the support stand during each swing cycle. Also, the swing motor is driven for a predetermined time interval to generate an angular impulse that is applied to the swing seat as it swings along the swing arc. The swing runs quietly because it includes no gearing. It also includes no high-drain resistors to slow the motor.

Additional objects, features, and advantages of the invention will be apparent to those skilled in the art upon consideration of the following detailed description of preferred embodiments exemplifying the best mode of carrying out the invention as presently perceived.

BRIEF DESCRIPTION OF THE DRAWINGS

The detailed description refers to the accompanying figures in which.

DETAILED DESCRIPTION OF THE DRAWINGS

Figure 1:
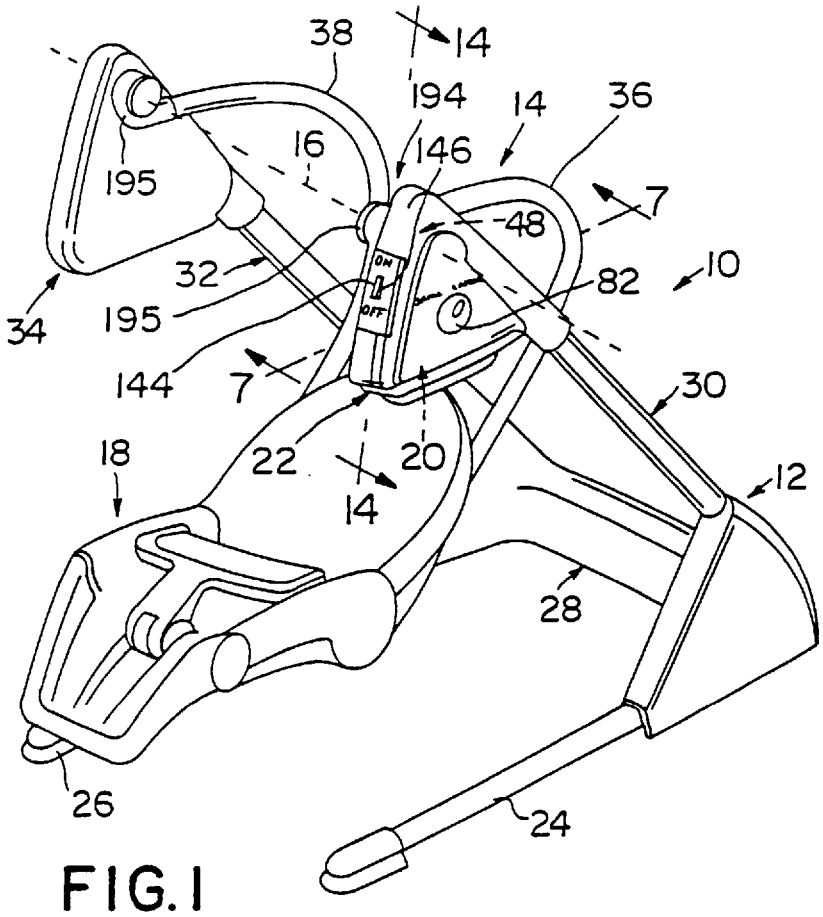
FIG. 1 is a perspective view of a swing including an automatic pendulum-drive system in accordance with the present invention and showing a support stand, a swing seat frame hanging from the support stand and carrying a swing seat, and a triangle-shaped housing containing the automatic pendulum-drive system.

Swing 10 includes a support stand 12, a swing seat frame 14 mounted on support stand 12 to swing about axis of rotation 16, and a seat 18 mounted on swing seat frame 14 as shown in FIG. 1. A pendulum-drive system 20 is contained in a housing 22 mounted on support stand 12. Pendulum-drive system 20 is configured to apply an angular impulse to swing seat frame 14 as it swings about axis 16 and along a swing arc to sustain swinging movement of seat 18 and swing seat frame 14 about axis 16. Essentially, pendulum-drive system 20 is a compliant pendulum drive mechanism since it only provides energy to a pendulum to sustain swinging movement of the pendulum when the pendulum is in a position to receive and use such energy.

Support stand 12 includes a pair of floor legs 24, 26, a shroud 28, and a pair of inclined spaced-apart parallel support legs 30, 32 as shown in FIG. 1. Each support leg 30, 32 includes a lower end extending into shroud 28 and an upper end overlying one of the floor legs 24, 26. The housing 22 containing pendulum-drive system 20 is mounted on the upper end of the right-side support leg 30 and a matching but nearly empty housing 34 is mounted on the upper end of the left-side support leg 32. Pendulum-drive assembly 20 could be mounted in either one of housings 22 or 34.

Swing seat frame 14 includes a right-side hanger arm 36 pivotably coupled to housing 22 and a left-side hanger arm 38 pivotably coupled to housing 34 so that swing seat frame 14 and seat 18 are able to swing freely about axis 16 back and forth along a swing arc. Although many types of seats can be mounted on swing seat frame 14, a suitable seat is disclosed in U.S. patent application Ser. No. 08/334,723, filed on Nov. 4, 1994.

Figure 2:
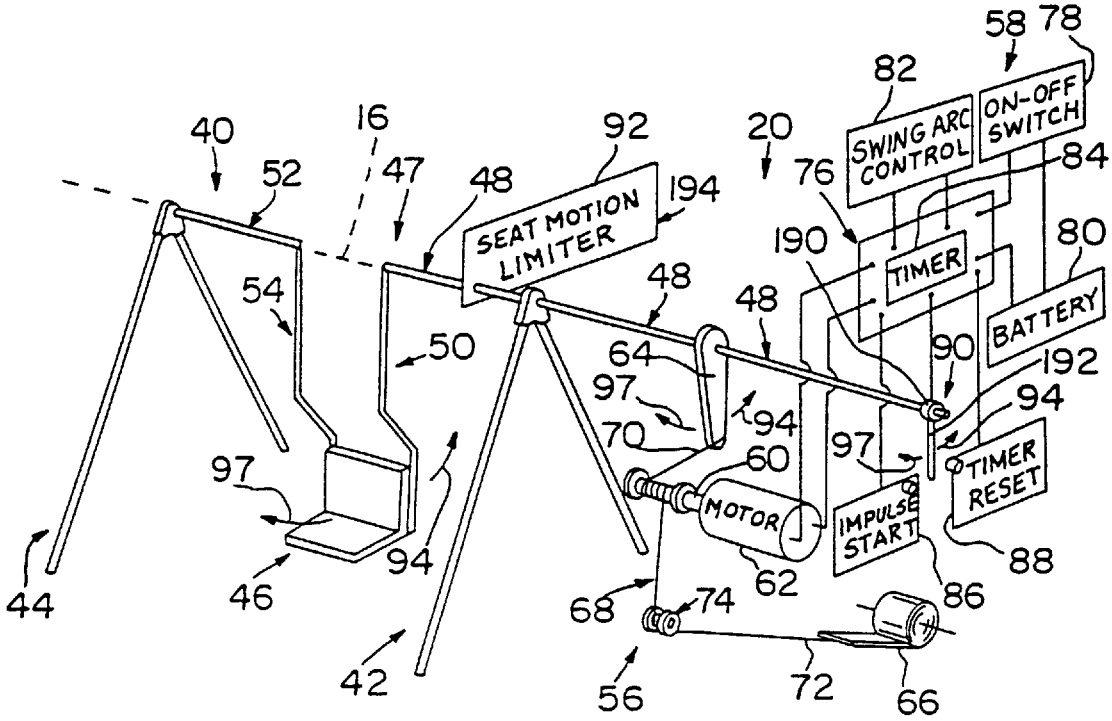
FIG. 2 is a schematic view of the swing shown in FIG. 1.

A schematic illustration of a swing 40 similar to swing 10 and pendulum-drive assembly 20 coupled to swing 40 similar is shown in FIG. 2. Swing 40 includes two support stands 42, 44, a seat 46, and a swing seat frame 47 including a drive shaft 48 mounted for rotation on right-side support stand 42, a right-side hanger arm 50 interconnecting seat 46 and drive shaft 48, an auxiliary shaft 52 mounted for rotation on left-side support stand 44, and a left-side hanger arm 54 interconnecting seat 46 and auxiliary shaft 52.

Pendulum-drive system 20 includes a torque-producing system 56 for applying a torque to drive shaft 48 to maintain swinging movement of seat 46 about axis 16 and an actuator system 58 for controlling actuation and run time of torque-producing system 56. In a presently preferred embodiment, torque-producing system 56 applies a torque of about 33 g-cm to drive shaft 48 and actuator system 58 allows this torque to be applied for a duration of about 0.2 seconds to 0.7 seconds.

Torque-producing system 56 includes a motor shaft 60 turned by an electric motor 62, a drive lever 64 fixed or keyed to drive shaft 48 to turn therewith, a line-tensioning spring 66, and a drive line 68 having one end 70 coupled to a free end of drive lever 64, an opposite end 72 coupled to line-tensioning spring 66, one middle portion wrapped around motor shaft 60, and another middle portion engaging idler pulley 74. In a presently preferred embodiment, the ratio of the drive lever 64 to the motor shaft 60 is about 50:1.

Actuator system 58 includes an electrical circuit 76 containing on-off switch 78, battery 80, swing arc control 82, motor timer 84, impulse-start contact 86, and timer-reset contact 88. Actuator system 58 also includes an electrically conductive slip switch 90 mounted on one end of drive shaft 48 and configured to establish electrical contact with the impulse-start contact 86 to start motor timer 84 at the proper moment in each swing cycle and actuate motor 62. In a presently preferred embodiment, slip switch 90 is also arranged and configured to establish electrical contact with timer-reset contact 88 at the proper moment during one swing cycle to reset the motor timer 84 for use during a next or succeeding swing cycle. Motor timer 84 does not necessarily have to be reset with a contact point. This method is used herein so that if slip switch 90 bounces and recontacts impulse-start contact 86, the motor 62 will not be pulsed again during the same period.

Although the operation of pendulum-drive system 20 will be described in greater detail below, it is helpful to understand that slip switch 90 is mounted and configured to pick up on, sense, or otherwise detect the natural frequency (and period) of swing seat frame 47 and seat 46 even when seat 46 is empty and even when a child of any mass moves about while seated in seat 46 during swinging movement of seat 46 about axis of rotation 16. As such slip switch 90 is able to actuate electric motor 62 so that torque-producing system 56 applies a torque to swing seat frame 47 at the right moment during a swinging cycle in a manner that is in tune and compatible with the natural frequency (and period) of swing seat frame 48, 50, 54, seat 46, and any stationary or moving occupant (not shown) of seat 46. The angular impulse generated by motor 62 and motor timer 84 is always in the direction of seat travel so that the impulse is never against the natural movement of swing seat frame 14 and seat 18 so as not to slow down swing 10 or cause excessive current draw. The motor 62 will run and torque will be applied to the swing seat frame 47 via drive shaft 48, drive lever 64, and drive line 68 to swing seat 46 until the motor timer 84 shuts off the motor 62 after the motor 62 has run for a short predetermined time interval. The motor start time and run time is not dictated by the position of swing seat frame 47 relative to support stand 42, 44, but rather is controlled by (1) the rotational position of drive shaft 48 and right-side hanger arm 50 about axis 16 and relative to a first extreme position along a swing arc and (2) the time interval set by motor timer 84.

In use, electrical engagement of slip switch 90 and impulse-start contact 86 starts motor timer 84 which in turn starts electric motor 62. Then, electric motor 62 is turned off by the motor timer 84 during swinging movement of seat 46 in direction 97 along a swing arc at positions between the first and second extreme positions of seat 46 along the swing arc. Then motor timer 84 is reset due to electrical engagement of slip switch 90 and timer-reset contact 88 during swinging movement of seat 46 in an opposite direction 94 from the second extreme position to the first extreme position. In a presently preferred embodiment, the motor 62 is actuated and allowed to run for a predetermined time interval to apply an angular impulse to the swing seat frame and seat once during each swing cycle. It is within the scope of the present invention, however, to use torque-producing system 56 and actuator system 58 to apply one or more angular impulses to the swing seat frame and seat during each swing cycle or during any predetermined or random series of swing cycles.

Drive shaft 48 includes a seat-motion limiter 92 that is configured to limit the torque applied to swing seat frame 47 as seat 46 swings along the swing arc. Although a presently preferred embodiment of seat motion limiter 92 includes a mechanical assembly positioned diagrammatically as shown in FIG. 2 (and shown in more detail in FIGS. 6 and 14–16), seat-motion limiter 92 can alternatively include an electronic limit switch and circuit system (not shown) positioned and configured to sense and limit torque applied to swing seat frame 47 and seat 46. A more detailed description of seat-motion limiter 92 will be provided below.

Figure 3:
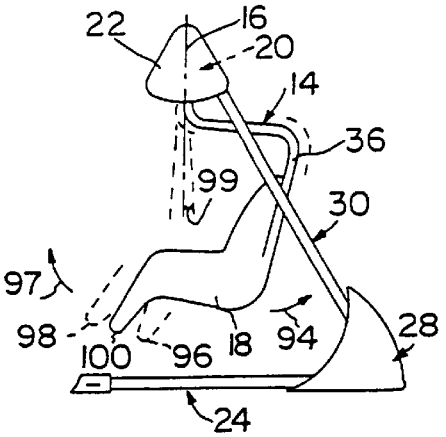
FIG. 3 is a side elevation view of the swing of FIG. 1 showing a swing seat moving along a short swing arc from a first or rear extreme position (dotted lines) to a second or forward extreme position (dotted lines)
Figure 4:
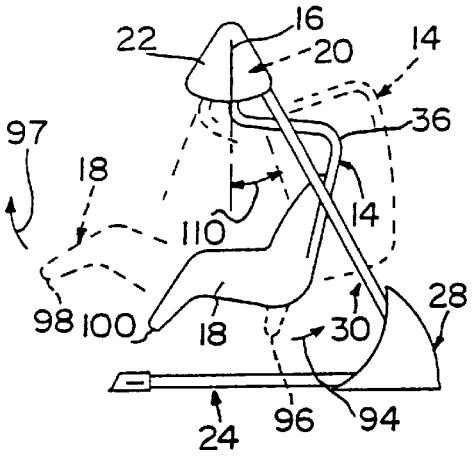
FIG. 4 is a view similar to FIG. 3 showing a swing seat moving along a long swing arc from a first or rear extreme position (dotted lines) to a second or forward extreme position (dotted lines)

There are many ways to cause pendulum-drive system 20 to begin operating, and some of these are shown in FIGS. 3 and 4. A user (such as a parent or child care giver) can pull seat 18 back in direction 94 to a first extreme position 96 and release it or push seat 18 forward in direction 97 to a second extreme position 98 and release it. FIG. 3 shows how even a small angular displacement 99 of seat 18 from its equilibrium position 100 is sufficient to cause pendulum-drive system 20 to operate. In fact, in many cases, pendulum-drive system 20 is almost self-starting because any swinging movement of seat 18 about axis of rotation 16 such as might be caused by movement of a child seated in seat 18 relative to seat 18 is sufficient to cause seat 18 to swing and pendulum-drive system 20 to operate. FIG. 4 shows how a larger angular displacement 110 of seat 18 from its equilibrium position 100 is sufficient to cause seat 18 to swing and pendulum-drive system 20 to operate.

Figure 5:
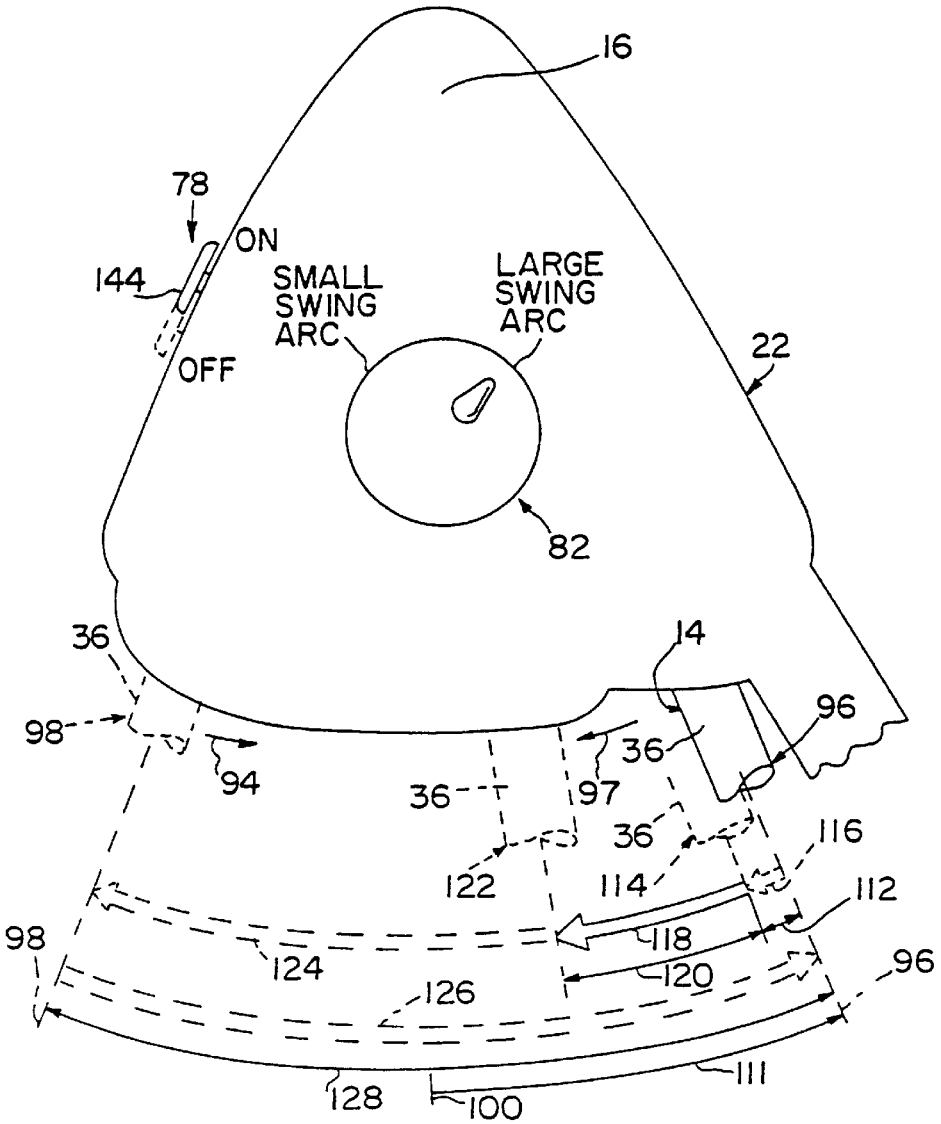
FIG. 5 is an enlarged side elevation view of the triangle-shaped housing and a portion of the swing seat frame of FIG. 4 showing one swing cycle of the swing seat frame in which the frame (solid lines) starts at the first extreme position, swings freely through a predetermined angle of about 5° (dotted line short double arrow) to an actuation position, is driven by a motor for a predetermined interval of time as it swings (solid line double arrow) from the actuation position toward the second extreme position, swings freely again (dotted line long double arrow) to reach the second extreme position, and then swings freely in an opposite direction (dotted line longest double arrow) from the second extreme position back to the first extreme position so that a next swing cycle can begin.

The sequence of free-swinging and motor-driving movement of swing seat frame 14 during a typical swinging cycle is illustrated diagrammatically in FIG. 5. In this illustrative example, based on the view shown in FIG. 4, swing seat frame 14 is displaced at an angle 111 of about 20° from its equilibrium position 100 when it occupies its first extreme position 96 as shown in FIG. 5. Swing arc control 82 has been moved to its "large swing arc" setting. As noted previously, it really does not matter how swing seat frame 14 is caused to move initially to first extreme position 96. Also, the convention of saying that the swinging cycle "begins" at position 96 is for illustrative purposes only since a cycle could be said to begin at any point along the swing arc of an oscillating body such as the swing seat frame and seat.

A presently preferred sequence of operation is as follows: First, swing seat frame 14 is allowed to swing freely in direction 97 from first extreme position 96 through a predetermined angle 112 to an actuation position 114 (established by electrical engagement of slip switch 90 and impulse-start contact 86) in a manner represented by a dotted-line short double arrow 116. The motor 62 is not running when swing seat frame 14 is in its first extreme position 96 or at any time during movement of the swing seat frame 14 from first extreme position 96 to actuation position 114. As swing seat frame 14 reaches actuation position 114, motor timer 84 is started which in turn starts electric motor 62.

Second, electric motor 62 runs for a predetermined time interval set by motor timer 84 to cause an angular impulse to be applied to swing seat frame 14 as swing seat frame 14 moves in direction 97 in a manner represented by solid line double arrow 118. The angular displacement 120 of swing seat frame 14 as it moves from actuation position 114 to a motor-off position 122 can vary as the motor run time is a function only of time governed by motor timer 84 and is not a predetermined angle.

Third, swing seat frame 14 is allowed to swing freely in direction 97 from its motor-off position 122 to its second extreme position 98 in a manner represented by dotted-line long double arrow 124. Motor 62 is not running when swing seat frame 14 is in its second extreme position 98 or at any time during movement of swing seat frame 14 from motor-off position 122 to second extreme position 98.

Fourth, swing seat frame 14 is allowed to swing freely in direction 94 from second extreme position 98 to first extreme position 96 in a manner represented by dotted-line longest double arrow 126 to complete one swing cycle having an amplitude 128) and the next swing cycle begins. Motor timer 84 is reset automatically during such free-swinging movement of swing seat frame 14 from second extreme position 98 to first extreme position 96. Such a sequence of steps could be used to sustain swinging movement of seat 18 regardless of the magnitude of amplitude 128 (which can be changed using swing arc control 82).

Figure 6:
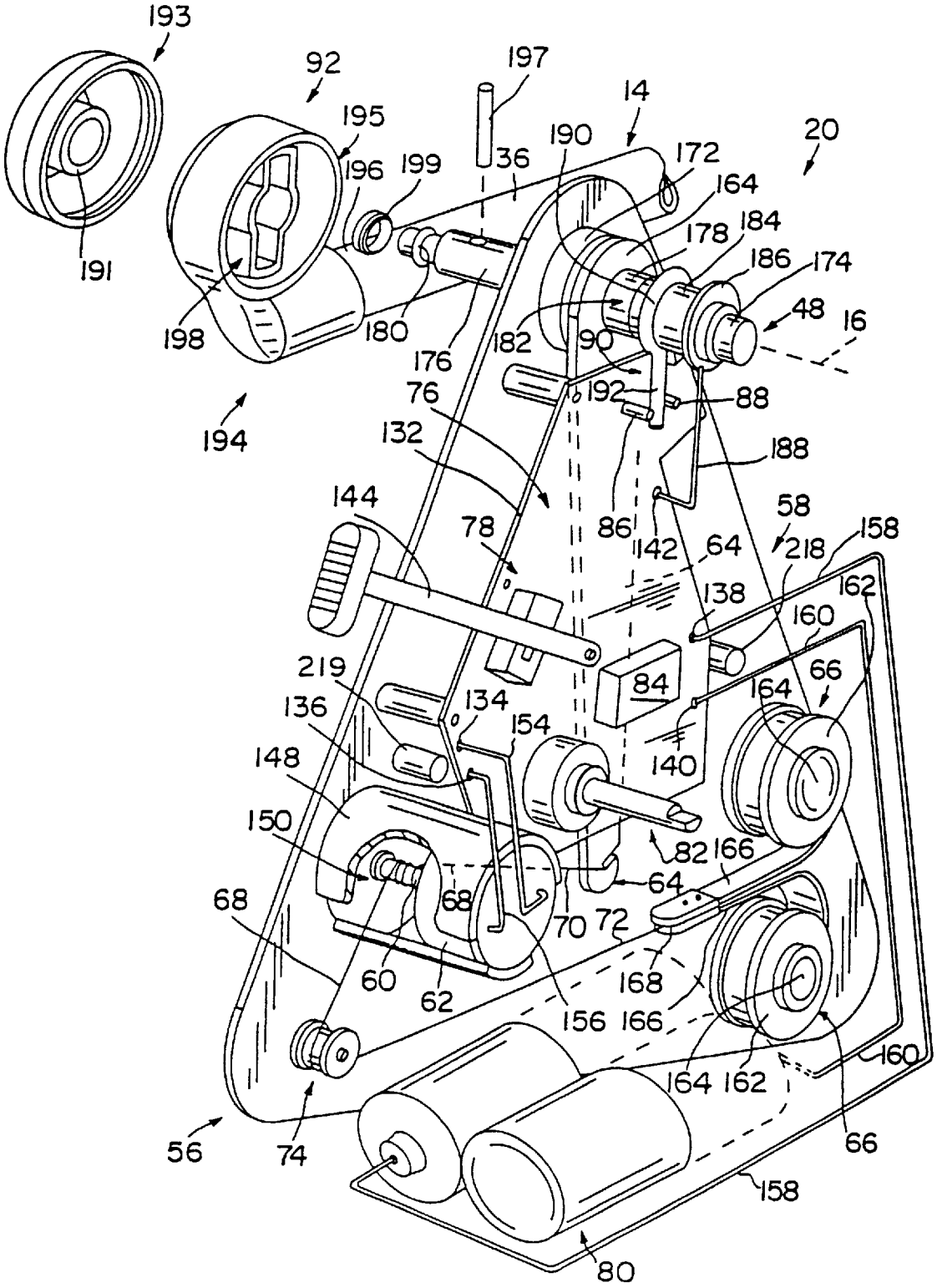
FIG. 6 is a perspective view of a presently preferred embodiment of the automatic pendulum-drive system showing an electric swing motor, a battery pack, a drive lever coupled to a drive shaft, a drive line coupled to the drive lever and a drive line-tensioning spring assembly and wrapped around a motor shaft, a swing arc control potentiometer, a slip switch coupled to the drive shaft, an on-off lever switch, and a lost-motion overrun assembly interconnecting the swing seat hanger arm and the portion of the drive shaft carrying the slip switch.

One embodiment of torque-producing system 56 and actuator system 58 is shown in perspective in FIG. 6 and in operation in FIGS. 7–12. Referring now to FIG. 6, a panel 130 included in housing 22 carries a circuit board 132 thereon. Circuit board 132 carries a suitable electrical circuit 76 of the type diagrammed, for example, in FIG. 13. Circuit board 132 also carries an on-off switch 78, swing arc control potentiometer 82, motor timer 84, impulse-start contact 86, timer-reset contact 88, motor terminals 134, 136, battery terminals 138, 140, and ground terminal 142. An actuator lever 144 is pivotably coupled to circuit board 132 and arranged to connect to an on-off switch 78 and protrude through a slot 146 formed in housing 22 to enable a user to turn pendulum-drive system 20 on and off manually from a point located outside housing 22.

Figure 7:
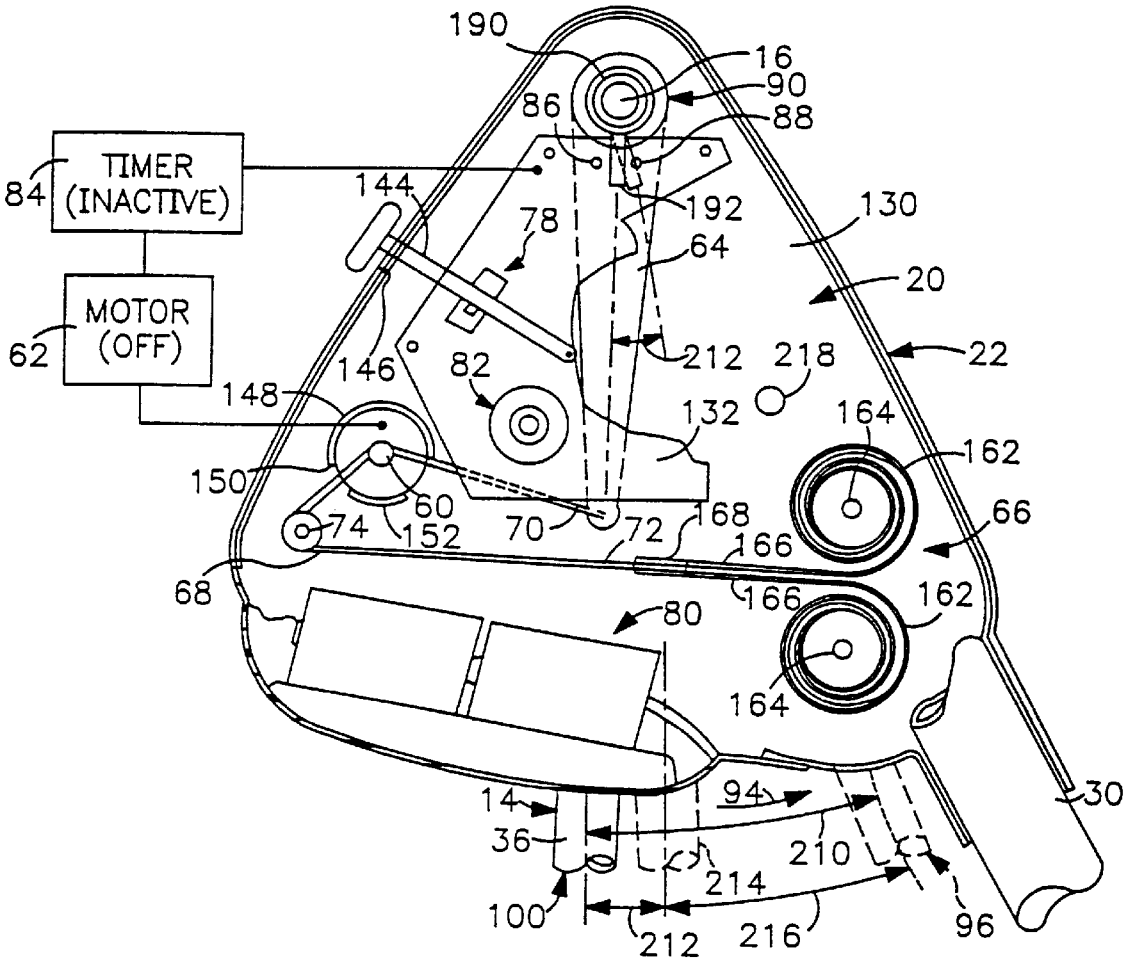
FIG. 7 is an elevation view taken along line 7—7 of FIG. 1 showing a hanger arm (solid lines) of the swing seat frame in an equilibrium position.

A motor mount 148 is coupled to housing panel 130 and arranged to support motor 62 so that motor shaft 60 lies in a space inside motor mount 148 and between housing panel 130 and motor 62. Motor mount 148 is formed to include first and second side openings 150, 152 for receiving portions of drive line 68 as shown in FIGS. 6 and 7. One brand of motor suitable for use as motor 62 is Mabuchi RF-500TB-18280 available from Mabuchi Motor Co., Ltd. of Detroit, Mich. Wire lead 154 couples motor 62 to positive terminal 134 and wire lead 156 couples motor 62 to negative terminal 136.

Four 1.5 volt cells are coupled to one another and to battery terminals 138, 140 using wire leads 158, 160 to supply electrical current to electrical circuit 133. Any suitable alternative could be used to supply power to electrical circuit 133. Illustratively, swing arc control potentiometer is Model No. 317-2090-500K available from Mouser.

Drive line 68 is a monofilament line made preferably of nylon and alternatively of urethane, steel, rubber, etc. or a suitable multiple filament material. In other embodiments (not shown), drive line 68 could be replaced by gearing, either spur or rack and pinion, or friction drive. Drive line 68 could be a continuous loop or a drive belt.

Figure 20:
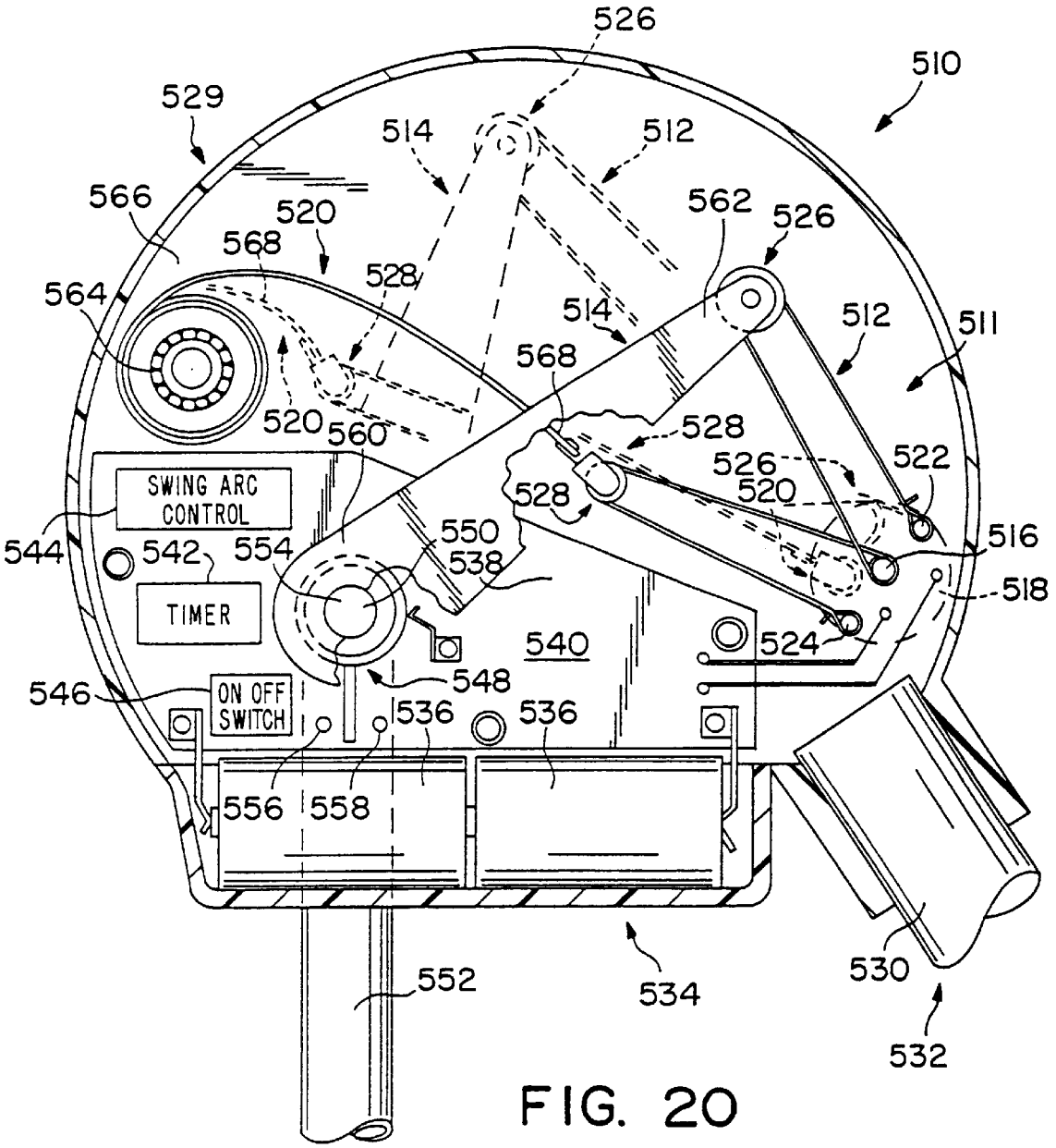
FIG. 20 is a side elevation view of the interior of a swing motor housing containing another embodiment of an automatic pendulum-drive system in accordance with the present invention and showing an electric swing motor having a motor shaft, a battery pack, a drive lever having a base end coupled to the drive shaft and a free end carrying a pulley, a drive line-tensioning spring having a free end carrying a pulley, spaced-apart first and second drive line posts arranged to position the motor shaft therebetween, a drive line having one end coupled to the first drive line post, another end coupled to the second drive line post, and a middle portion wrapped around the pulley on the drive line-tensioning spring, the motor shaft, and the pulley on the drive lever, and a slip switch coupled to the drive shaft.

Line-tensioning spring 66 is illustratively a pair of constant-force (negator) springs 162 mounted on bearings 164 fixed to housing panel 130 in "back-to-back" relation as shown in FIG. 6. By aligning springs 162 in back-to-back relation, unwanted twist of springs 162 is prevented. Each spring 162 has a free end 166 and these free ends 166 are joined together as shown in FIG. 6 by a connector 168 joined to one end 72 of drive line 68. Each spring 162 is preferably available from Sandvik Steel and has the following characteristics: material-texture rolled carbon steel that is 0.006 inch thick by 0.375 inch wide by 17 inches long. Line-tensioning spring 66, and in particular this pair of constant-force springs 162, functions to keep drive line 68 taut enough so as not to slip on the motor shaft 60. A gravity counterweight (not shown) could be coupled to drive line 68 and used instead of constant-force springs 162. Many other types of springs could also be used. In one embodiment (not shown), an endless loop tensioned by a spring could be used instead of drive line 68 and constant-force springs 162. An alternative embodiment in which one constant force spring is used with a pulley system to tension a drive line is shown in FIG. 20.

Figure 14:
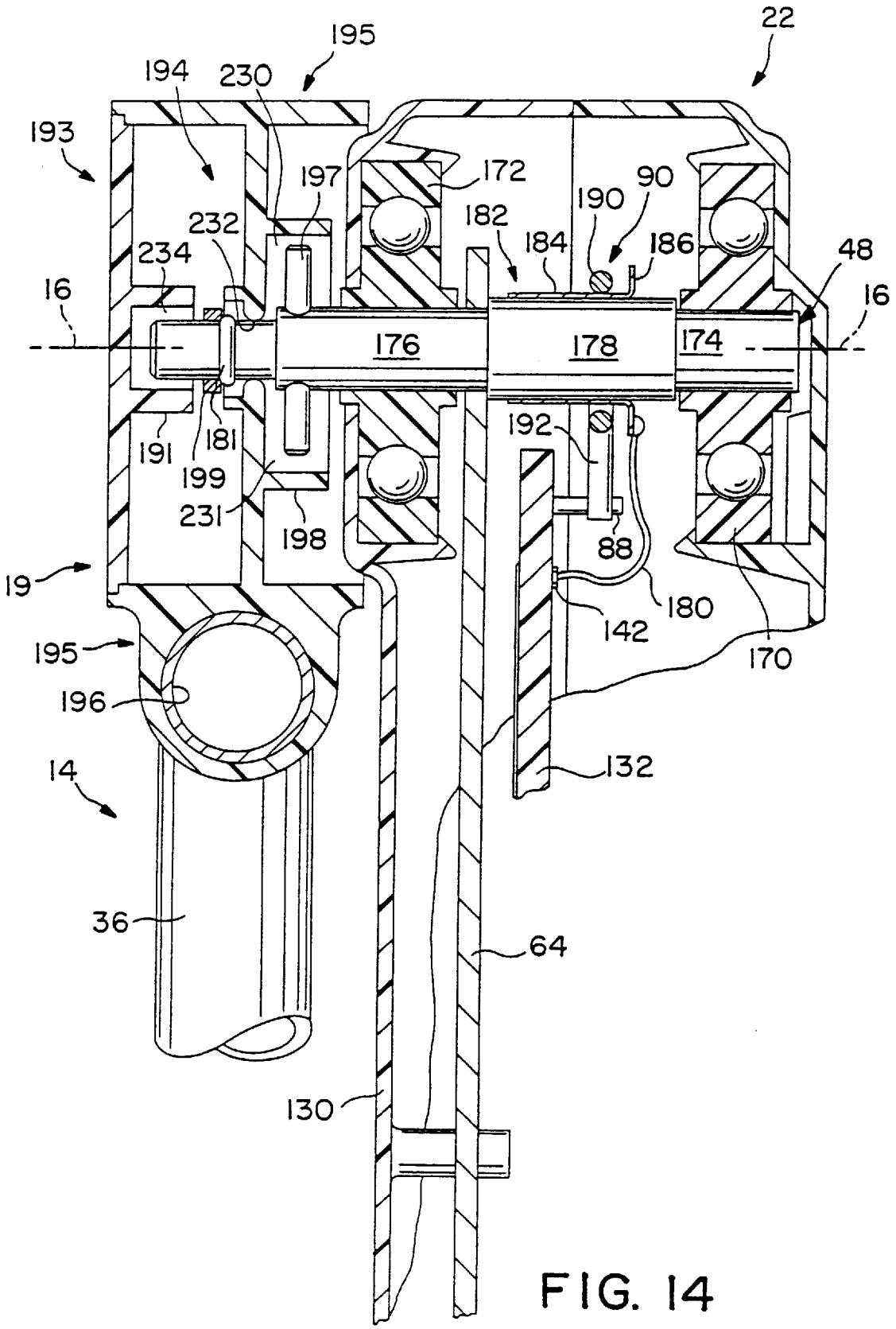
FIG. 14 is a sectional view taken along line 14—14 of FIG. 1 showing a lost-motion driving connection between one of the hanger arms and a drive shaft.

Drive shaft 48 is shown best in FIGS. 6 and 14. Drive shaft 48 is supported by shaft bearings 170, 172 mounted inside housing 22 for rotation about axis of rotation 16. Drive shaft 48 is made out of a plastics material such as glass-filled nylon and includes a first bearing support 174 engaging outer shaft bearing 170, a second bearing support 176 engaging inner shaft bearing 172, a slip switch support 178 positioned to lie between first and second bearing supports 174, 176, and a retaining portion 180 appended to an end of second bearing support 176 and configured to include a retaining shoulder 181 (FIG. 14).

In a presently preferred embodiment, an electrically conductive fixture 182 includes a cylindrical sleeve 184 mounted on slip switch support 178 and an annular flange 186 appended to one end of cylindrical sleeve 184. In a presently preferred embodiment, cylindrical sleeve 184 has an outer diameter of 0.625 inch (15.88 mm) and is made of brass.

Electrically conductive fixture 182 is used to supply electrical current to the electrically conductive slip switch 90 which is carried on drive shaft 48 in such a way as to maintain electrical contact with cylindrical sleeve 184 during rotation of drive shaft 48 about axis of rotation 16. A ground wire 188 couples annular flange 186 to ground terminal 142 on circuit board 132 to ground electrically conductive fixture 182. In another embodiment (not shown), at least portions 174, 178 of drive shaft 48 are made of an electrically conductive plastics material, ground wire 188 is coupled to either portion 178, 174 (or another suitable portion), and slip switch 90 is mounted to establish electrical contact with conductive portion 178 (thus eliminating the need for fixture 182).

Slip switch 90 includes a slip ring 190 configured to wrap around the cylindrical sleeve 184 of electrically conductive fixture 182 that is mounted on the slip switch support 178 of drive shaft 48. Slip switch 90 also includes a switch arm 192 appended to slip ring 190 and positioned to hang down from drive shaft 48 and lie in a space formed between impulse-start contact 86 and timer reset contact 88 as shown, for example, in FIGS. 6–12 and 14. Slip switch 90 is made of an electrically conductive material such as brass so that at the proper time it can establish electrical communication with electrically conductive fixture 182 and either impulse-start contact 86 or timer-reset contact 88.

Slip ring 190 is sized relative to cylindrical sleeve 184 and the slip switch support 178 on drive shaft 48 so as to establish a slippable friction fit therewith. In a presently preferred embodiment, slip ring 190 has an inner diameter of 0.635 inch (16.13 mm). Cylindrical sleeve 184 is fixed to slip switch support 178 to rotate therewith. Slip ring 190 and switch arm 192 turn as a unit with the drive shaft 48 and electrically conductive fixture 182 only during angular movement of switch arm 192 between the laterally spaced-apart impulse-start contact 86 and timer-reset contact 88 because of frictional engagement between slip ring 90 and cylindrical sleeve 184. (If drive shaft 48 was itself made of an electrically conductive plastics material, the frictional engagement would be established directly between such a drive shaft and slip ring 90.) Slip ring 90 will "slip on" cylindrical sleeve 184 whenever drive shaft 48 continues to rotate about axis of rotation 16 following engagement of switch arm 192 and impulse-start contact 86 or switch arm 192 and timer-reset contact 88. Thus, a lost-motion connection between slip switch 90 and drive shaft 48 is established in response to certain rotation of drive shaft 48 about axis of rotation 16.

A torque-transmitting connection 194 is established between drive shaft 48 and right-side hanger arm 36 of swing seat frame 14. A currently preferred embodiment of this torque-transmitting connection 194 is illustrated in FIGS. 6 and 14 and will be discussed in greater detail below in connection with a discussion of seat-motion limiter 92 and FIGS. 14–16. A hanger mount 195 having an end cap 193 is coupled to an upper free end 196 of right-side hanger arm 36 and is molded out of polypropylene. A drive pin 197 is fixed to one end of second bearing support 176 as shown in FIGS. 6 and 14 to lie inside a drive socket 198 formed in hanger mount 195. In the illustrated embodiment, drive socket 198 is sized and configured to provide for a certain amount of lost motion between drive pin 197 and drive socket 198 during certain circumstances (to be described in more detail below). In alternative embodiments (not shown), drive pin 197 always engages drive socket 198 to provide a direct-drive connection therebetween.

A push washer or snap ring 199 is used to retain hanger mount 195 on retaining portion 180 of drive shaft 48 as shown best in FIG. 14. An annular shoulder 181 is molded onto the cylindrical retaining portion 180 as shown, for example, in FIGS. 6 and 14 and snap ring 199 is mounted to abut shoulder 181 as shown, for example, in FIG. 14. Torque is transmitted from drive shaft 48 to right-side hanger arm 36 by means of the torque-transmitting connection 194 established by drive pin 197 and drive socket 198 in hanger mount 195.

The condition of swing 10 when swing seat frame 14 hangs in an equilibrium position 100 is shown in FIG. 7. In this view, a portion of housing 22 is removed to show the position and orientation of various components in pendulum-drive system 20. Motor 62 and motor timer 84 are each shown diagrammatically along with a descriptive legend. Swing 10 is shown in FIG. 1 to be in an equilibrium position and diagrammatic swing 40 is shown in FIG. 2 to be in an equilibrium position. It will be understood that the shape of right-side hanger arm 36 has been changed somewhat from the shape of the preferred embodiment shown in FIG. 1 to have a "straight-down" shape similar to the shape of right-side hanger arm 50 in FIG. 2 (or the hanger arm in FIGS. 3–5) to make the discussion of a swing cycle shown in FIGS. 7–12 easier to follow.

As shown in FIG. 7, a parent or other child caregiver can pull swing seat frame 14 back in direction 94 toward support leg 30 from its equilibrium position 100 through angle 210 to first extreme position 96 (shown in dotted lines). As previously noted, this is but one of many ways for swing seat frame to reach its first extreme position 96 at the beginning of a swing cycle. Although the natural frequency (and period) of the swing frame 14 and seat 18 is a function of the magnitude of angle 210, pendulum-drive system 20 will operate whether the magnitude of angle 210 is large or small.

Continuing to refer to FIG. 7, it will be seen that slip switch 90 rotates about axis 16 in direction 94 as swing seat frame 14 moves from equilibrium position 100 through angle 212 to an intermediate position 214. At this point, continued motion of slip switch 90 in direction 94 about axis of rotation 16 is blocked by engagement of switch arm 192 and timer-reset contact 88. It will be understood that slip switch 90 is able to rotate about axis of rotation 16 through angle 212 during pullback of swing seat frame 14 because of frictional contact between slip ring 90 and electrically conductive fixture 182 on drive shaft 48. Because of a lost-motion connection (previously described) between slip switch 90 and drive shaft 48, swing seat frame 14 and drive shaft 48 are able to continue to rotate in direction 94 until swing seat frame reaches first extreme position 96. This can happen because slip ring 190 of slip switch 90 is able to slip on electrically conductive fixture 182 as swing seat frame 14 moves through angle 216 from intermediate position 214 to first extreme position 96 as shown in FIG. 7.

Figure 8:
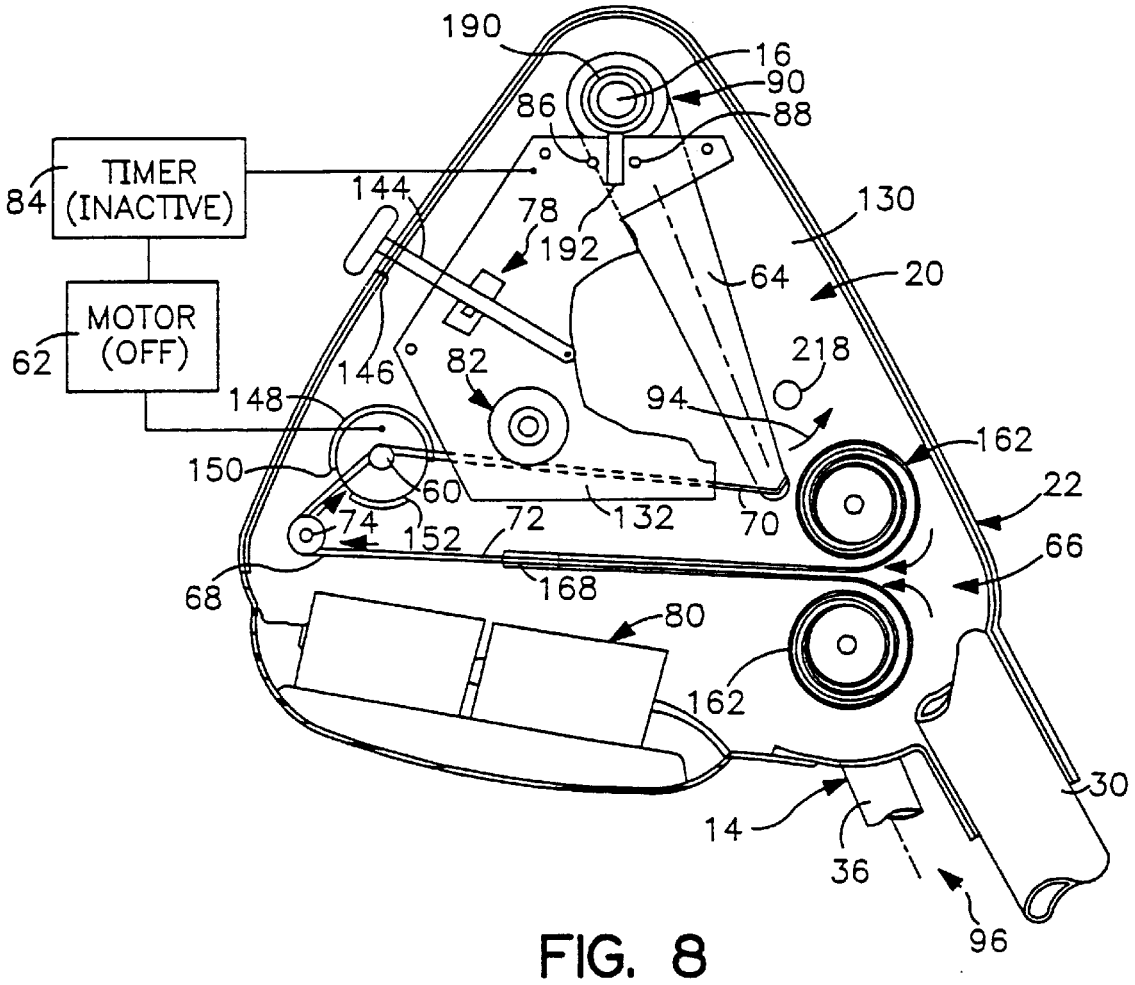
FIG. 8 is a view similar to FIG. 7 showing the hanger arm at a first extreme position at the beginning of a swing cycle and that the motor is off at this stage of the swing cycle.

The condition of pendulum-drive assembly 20 when swing seat frame 14 occupies its first extreme position 96 is shown in FIG. 8. At this point, electric motor 62 is off and motor timer 84 is inactive. On-off switch 78 has been moved manually to its on position to activate pendulum-drive system 20. Movement of swing seat frame 14 from the equilibrium position 100 shown in FIG. 7 to the first extreme position 96 shown in FIG. 8 causes drive lever 64 to pivot about axis of rotation 16 in direction 94 against a resisting force provided by drive line 68 which is tensioned by line-tensioning spring 66. A post 218 is mounted to housing panel 130 and arranged to extend in a horizontal position and lie inside housing 22 as shown in FIGS. 6, 7, and 8. Post 218 provides a barrier to block pivoting movement of drive lever 64 in direction 94 past a predetermined limit position.

Figure 9:
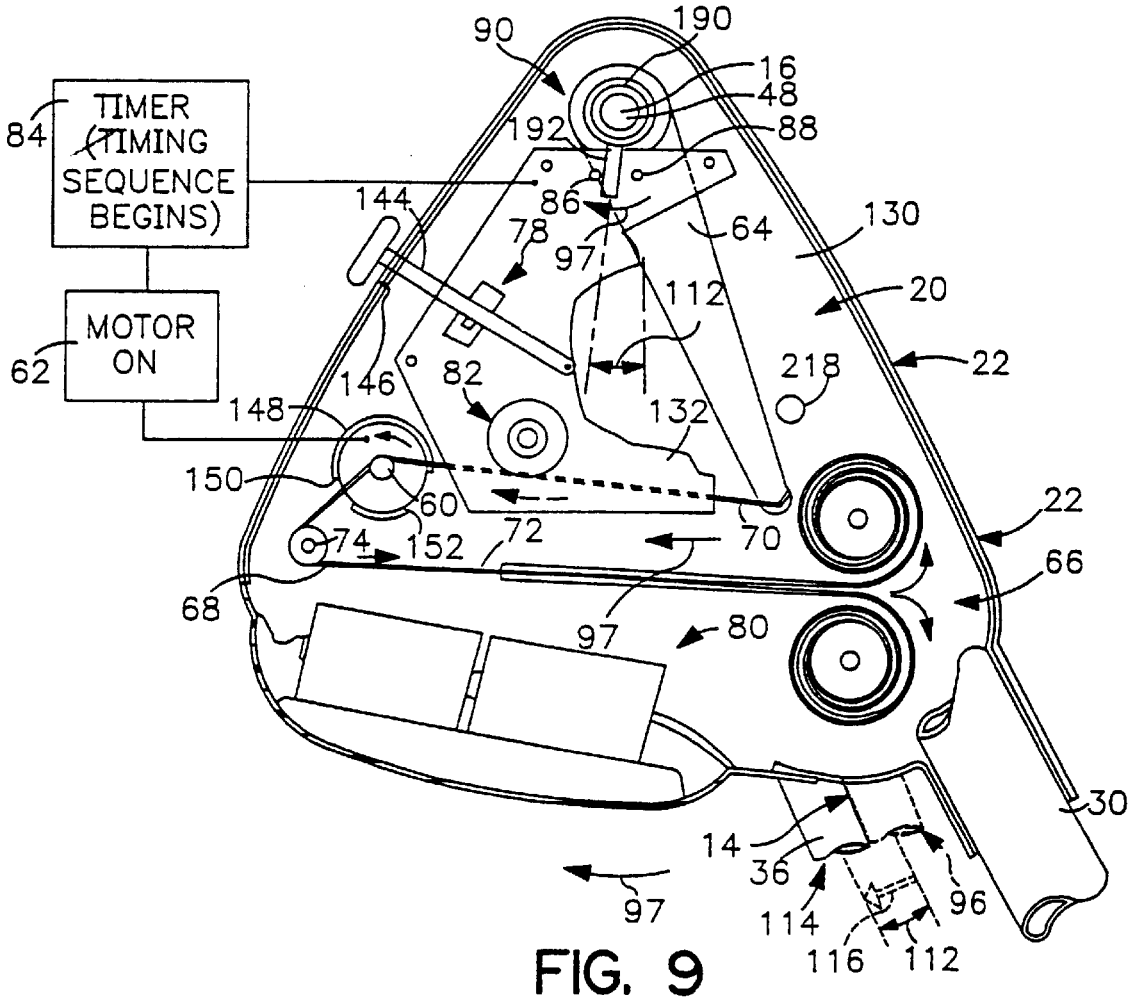
FIG. 9 is a view similar to FIGS. 7 and 8 showing the hanger arm after it has moved through a predetermined angle to reach the actuation position and showing that the impulse-start switch has moved to engage an impulse-start contact included in an electrical circuit causing the electrical circuit timer to start, which turns on power to the motor for a predetermined time.

At the start of each swing cycle, as shown in FIG. 9, swing seat frame 14 swings downwardly in direction 97 from first extreme position 96 (shown in dotted lines) to actuation position 114 (shown in solid lines) through a predetermined angle 112 in a manner represented by dotted line short double arrow 116. At the same time, drive lever 64 pivots about axis of rotation 16 in direction 97 and any slack on drive line 68 is taken up by tension provided by line-tensioning spring 66. As shown in FIG. 9, because of a frictional connection between slip switch 90 and drive shaft 48, switch arm 192 rotates about axis of rotation 16 through angle 112 during movement of swing seat frame 14 from first extreme position 96 to actuation position 114. At this point, switch arm 192 engages impulse-start contact 86 to complete an electrical circuit which generates an actuation signal to cause motor timer 84 to begin a timing sequence which in turn causes electric motor 62 to switch to a motor-on condition. Once electric motor 62 is actuated, motor shaft 60 will turn and pull on drive line 68 so as to generate a force pulling drive lever 64 about its pivot axis 16 in direction 97. It will be understood that drive line 68 and pivoting drive lever 64 act to transmit torque generated by motor 62 to drive shaft 48. The run time of electric motor 62 is controlled by motor timer 84.

Figure 10:
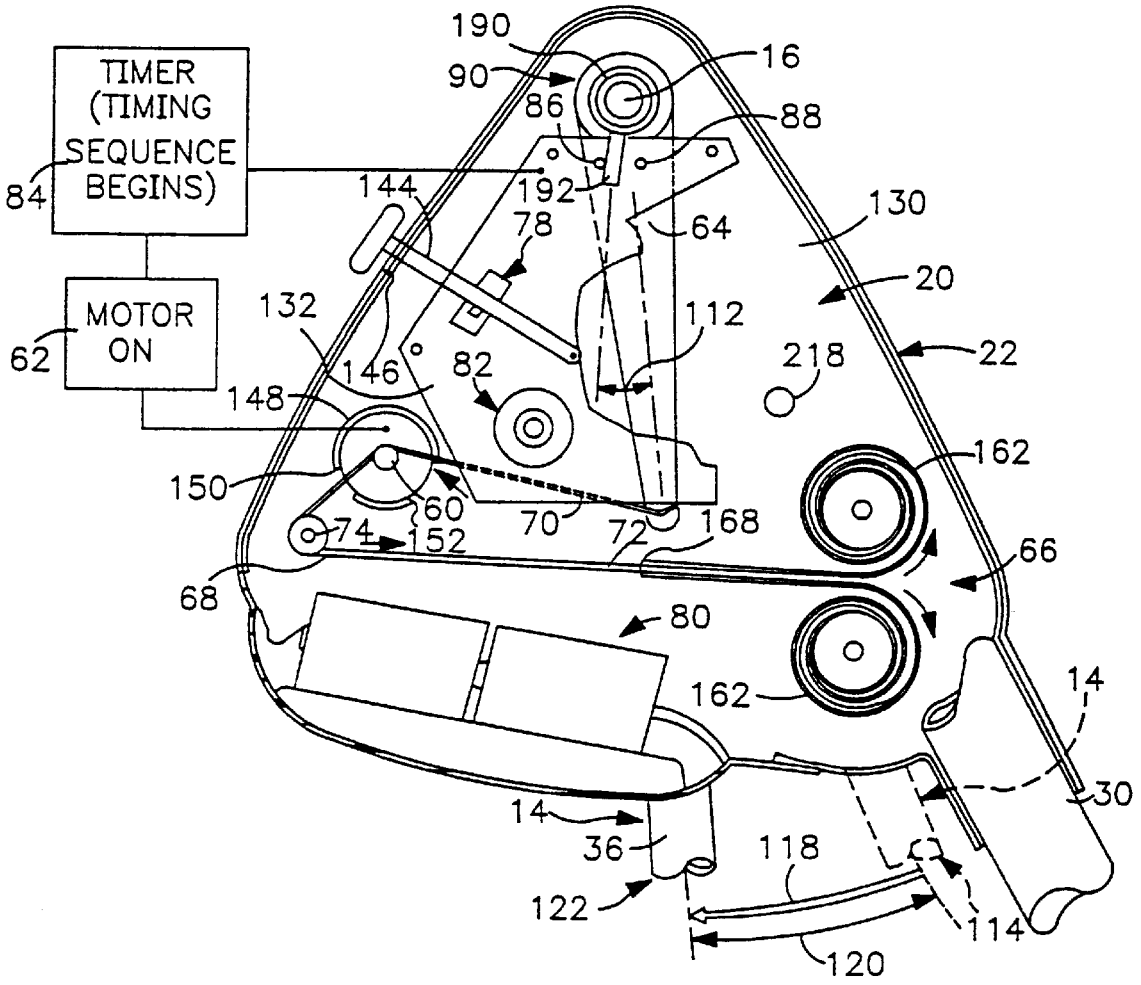
FIG. 10 is a view similar to FIGS. 7–9 showing the position of the hanger arm when the timing sequence governed by the electrical circuit timer ends and the timer shuts off power to the motor.

As shown in FIG. 10, the flow of electric current to electric motor 62 will be shut off automatically by motor timer 84 as soon as a predetermined time interval programmed into motor timer 84 ends. Motor shaft 60 turns due to torque applied by drive line 68 even when motor 62 is in its motor-off condition. Motor 62, motor shaft 60, drive line 68, and pivotable drive lever 64 function to apply an angular impulse to drive shaft 48 and swing seat frame 14 during movement of swing seat frame 14 from actuation position 114 to motor-off position 122 as shown diagrammatically by solid line double arrow 118 in FIG. 10. It happens that swing seat frame 14 has moved through angular displacement 120 during the time that motor 62 is running; however, angular displacement 122 is controlled only by motor timer and is not a predetermined angle based on movement of swing seat frame 14 relative to support stand 12.

Figure 11:
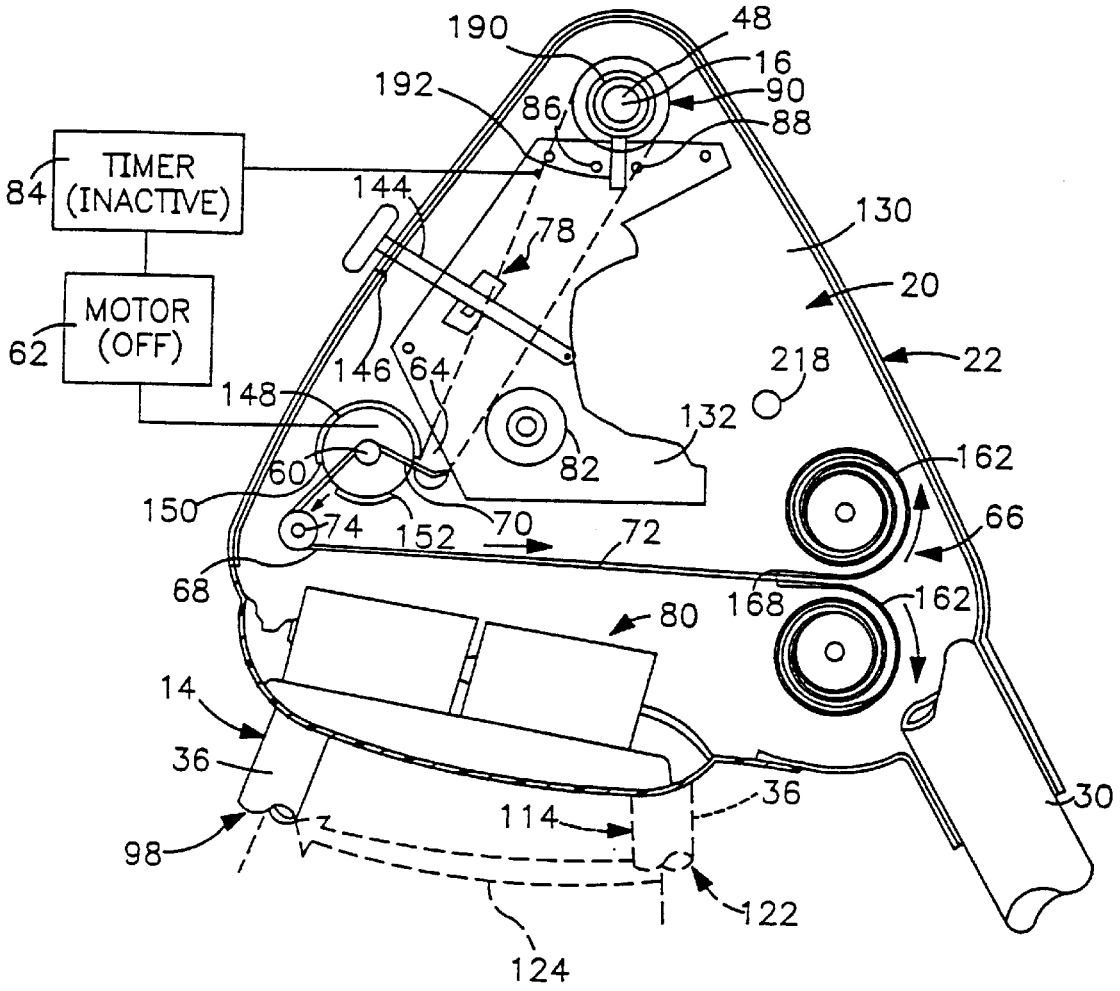
FIG. 11 is a view similar to FIGS. 7–10 showing that the motor is off when the hanger arm reaches a second extreme position following free swinging movement of the hanger arm from its motor-off position to its second extreme position.

Movement of swing seat frame 14 from motor-off position 122 (shown in dotted lines) to second extreme position 98 (shown in solid lines) is shown in FIG. 11. At this stage, momentum associated with swing seat frame 14 has rotated drive shaft 48 and the drive lever 64 attached thereto to the position shown in FIG. 11. Any slack on drive line 68 has again been taken up by line-tensioning spring 66. Electric motor 62 is in its motor-off condition and motor timer 84 is inactive when swing seat frame 14 reaches second extreme position 98. Movement of swing seat frame 14 from its motor-off position 122 to its second extreme position 98 is represented by dotted-line long double arrow 124. At this position, switch arm 192 of slip switch 90 remains in engagement with impulse-start contact 86.

Figure 12:
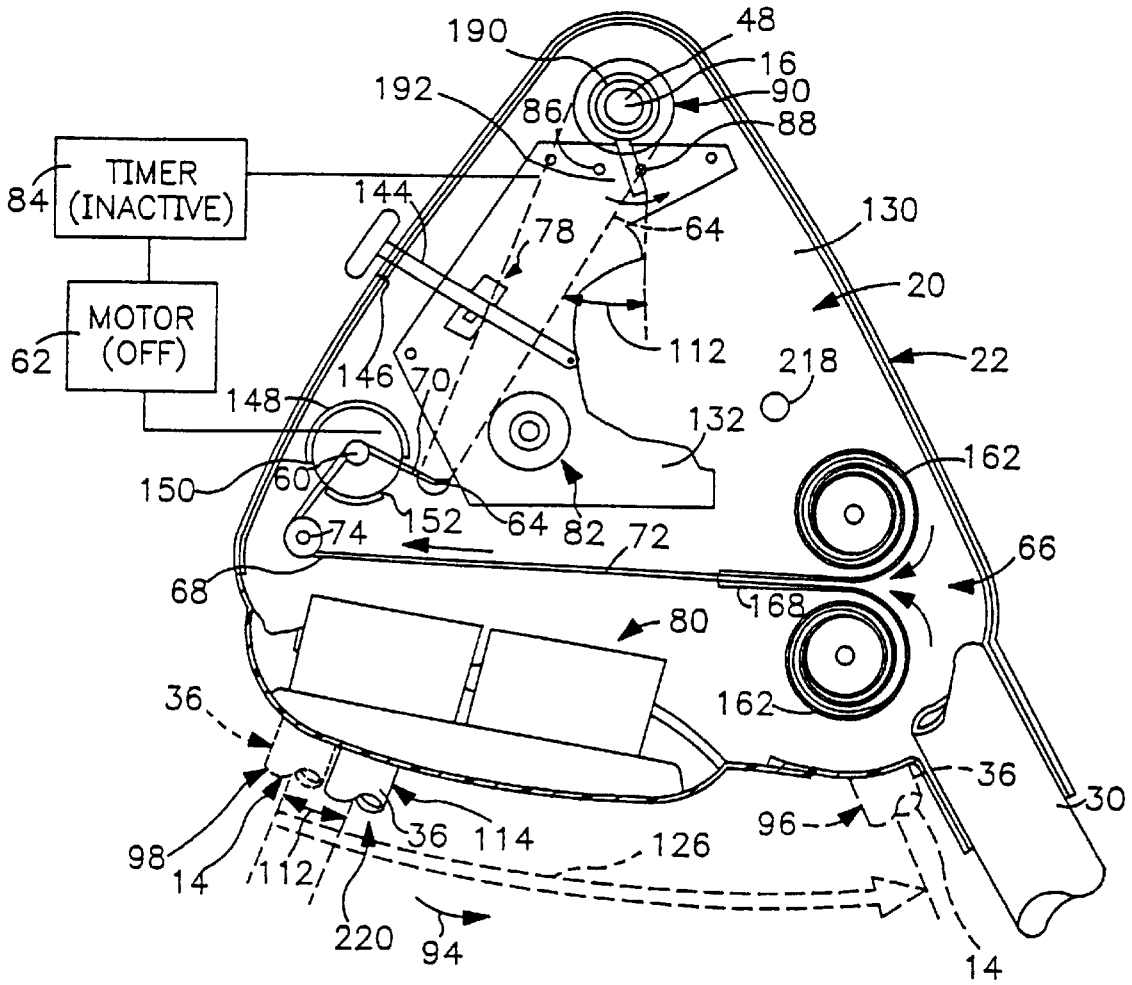
FIG. 12 is a view similar to FIGS. 7–11 showing that the impulse-start switch has moved to engage a timer-reset contact also included in the electrical circuit to reset the timer for the next swing cycle following free-swinging movement of the hanger arm from the second extreme position through a predetermined angle toward the first extreme position while the motor is off.

Slip switch 90 is operable to reset motor timer 84 in the manner shown in FIG. 12. Once swing seat frame 14 peaks at its second extreme position, it changes direction and begins to swing in direction 94 due to gravity back toward first extreme position 96 (dotted lines). Because of frictional engagement of slip switch 90 and drive shaft 48, angular movement of swing seat frame 14 in direction 94 from second extreme position 98 (dotted line) through angle 112 to timer-reset position 220 (solid line) causes switch arm 192 to pivot about axis of rotation 16 from engagement with impulse-start contact 86 through angle 112 to a point engaging timer-reset contact 88. Such engagement completes an electrical circuit which causes motor timer 84 to be reset and made ready for the next swing cycle. Meanwhile, due to a lost-motion connection between slip switch 90 and drive shaft 48, swing seat frame 14 is able to continue to swing freely in direction 94 until it reaches first extreme position 96 (dotted lines). Swing seat frame 14 is able to swing freely from its second extreme position in direction 94 until it reaches first extreme position 96 in a manner represented by dotted-line longest double arrow 126 because motor 62 is off during the entire time that swing seat frame 14 swings from second extreme position 98 to first extreme position 96.

When seat 18 is swinging on its natural forward motion (direction 97), slip switch 90 comes in contact with impulse-start contact 86 to start the timer circuit. The timer circuit duration is governed by the setting of swing arc control potentiometer 82. The circuit operates to deliver a pulse to motor 62, assisting in the forward motion of seat 18 (in direction 97). On return motion of seat 18 in direction 94, slip switch 90 contacts timer-reset contact 88 resetting motor timer 84 for the next cycle. The greater the setting of the potentiometer, the longer the motor on time and the greater the swing arc. In a presently preferred embodiment, motor timer 84 runs for 0.02 seconds at the small swing arc setting of potentiometer 182 and for 1.2 seconds at the large swing arc setting of potentiometer 182.

Figure 13:
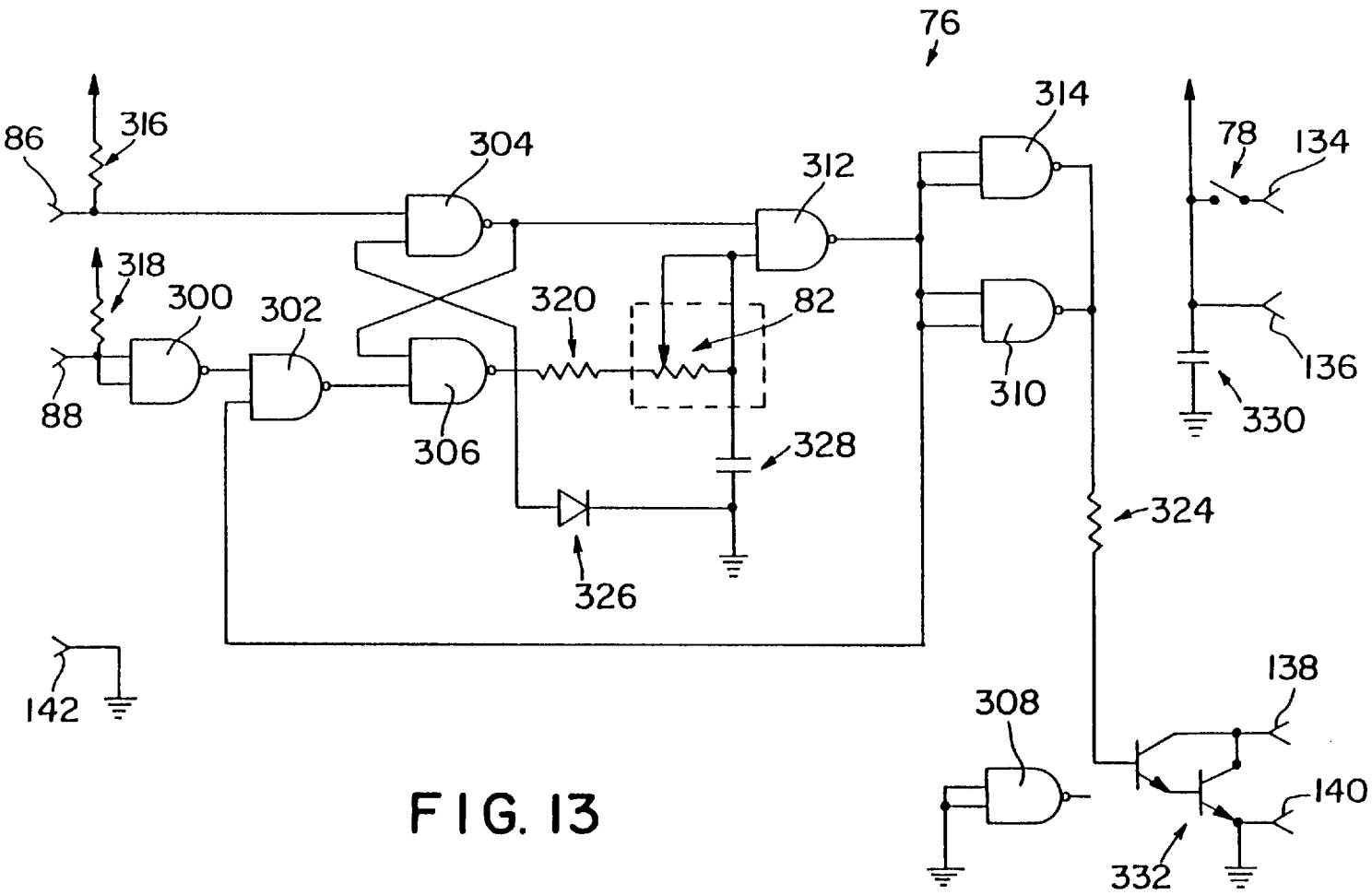
FIG. 13 is a schematic of a presently preferred electrical circuit included in the automatic pendulum-drive system in accordance with the present invention.

An example of one suitable electrical circuit 76 is shown schematically in FIG. 13. Circuit 76 includes timer-start input 86, timer-reset input 88, ground connection 142, battery positive connection 134, motor positive connection 136, motor negative connection 138, and battery negative connection 140.

Circuit 76 includes circuit elements 300, 302, 304, and 306. Elements 300, 302, 304, 306 are positive trigger NAND gates contained within a 74HC00 DIP integrated circuit. Circuit 76 also includes circuit elements 308, 310, 312, and 314. Elements 308, 310, 312, 314 are positive Schmidt trigger NAND gates contained within a 74HC132 DIP integrated circuit.

Circuit 76 also includes (4 W, 10 KΩ) resistor 316, (4 W, 10 KΩ) resistor 318, (4 W, 100 KΩ) resistor 320, (TRIMPOT, 500 KΩ) variable resistor 82, and (4 W, 1 KΩ) resistor 324. Circuit 76 also includes (50 piv) diode 326, (1.0 microfarad electrolytic) capacitor 328, (0.1 microfarad monolithic) capacitor 330, and SPST-NO switch 78.

Circuit 76 provides on-off and swing arc control for swing 10. Power from four D cells 80 is applied to terminals 138, 140. The pendulum-drive system 20 of swing 10 is turned on by closing switch 78. Power is then applied to control circuit 76 and the positive side of motor 62 via terminal 134. The one-shot, non-retriggerable timer circuit is activated by grounding 86 to 142 when swing seat frame 14 reaches actuation position 114. The circuit formed by elements 304, 306, 312, 320, 82, 326, and 328 is then triggered and provides a timed output pulse to element 332. Element 332 is a power darlington silicon power transistor, part number TIP120. With element 332 on, the negative connection 136 of motor 62 is grounded, thus turning on the motor 62. The motor-on time is determined by the position of the arc control potentiometer 82. The one shot, non-retriggerable timer circuit is reset by grounding 88 to 142 at the timer-reset position 220 of swing seat frame 14. The cycle then continues until pendulum-drive system 20 is turned off by switch 78.

Figure 15:
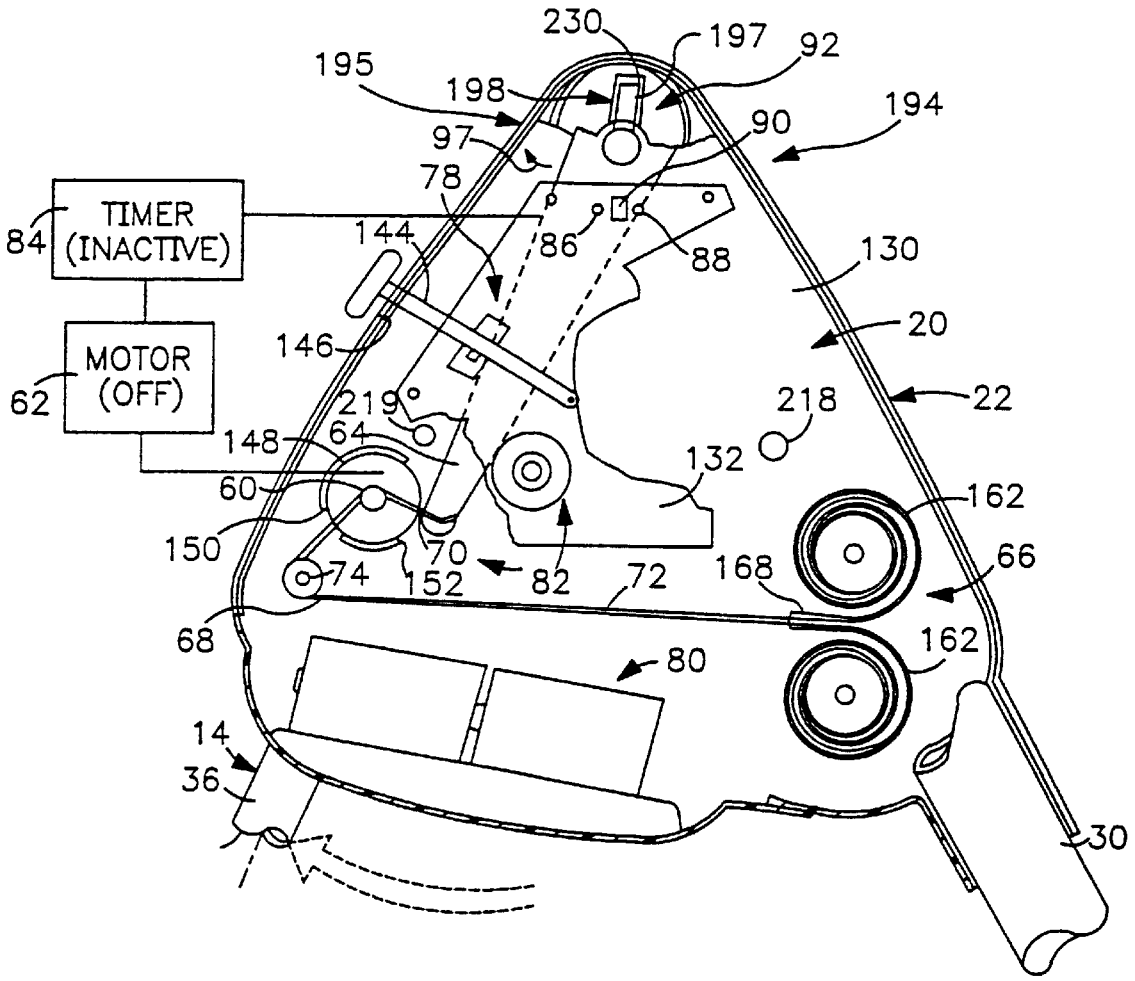
FIG. 15 is a view similar to FIGS. 7–12 showing a drive pin engaged with a hanger mount to drive the swing seat.

During normal motor-driven operation of swing seat frame 14, the angular impulse generated by motor 62 is transmitted from drive shaft 48 to hanger mount 195 (and right-side hanger arm 36 of swing seat frame 14) by engagement of drive pin 197 on drive shaft 48 against drive socket 198 on hanger mount 195 at contact point 230 as shown in FIG. 15.

Figure 16:
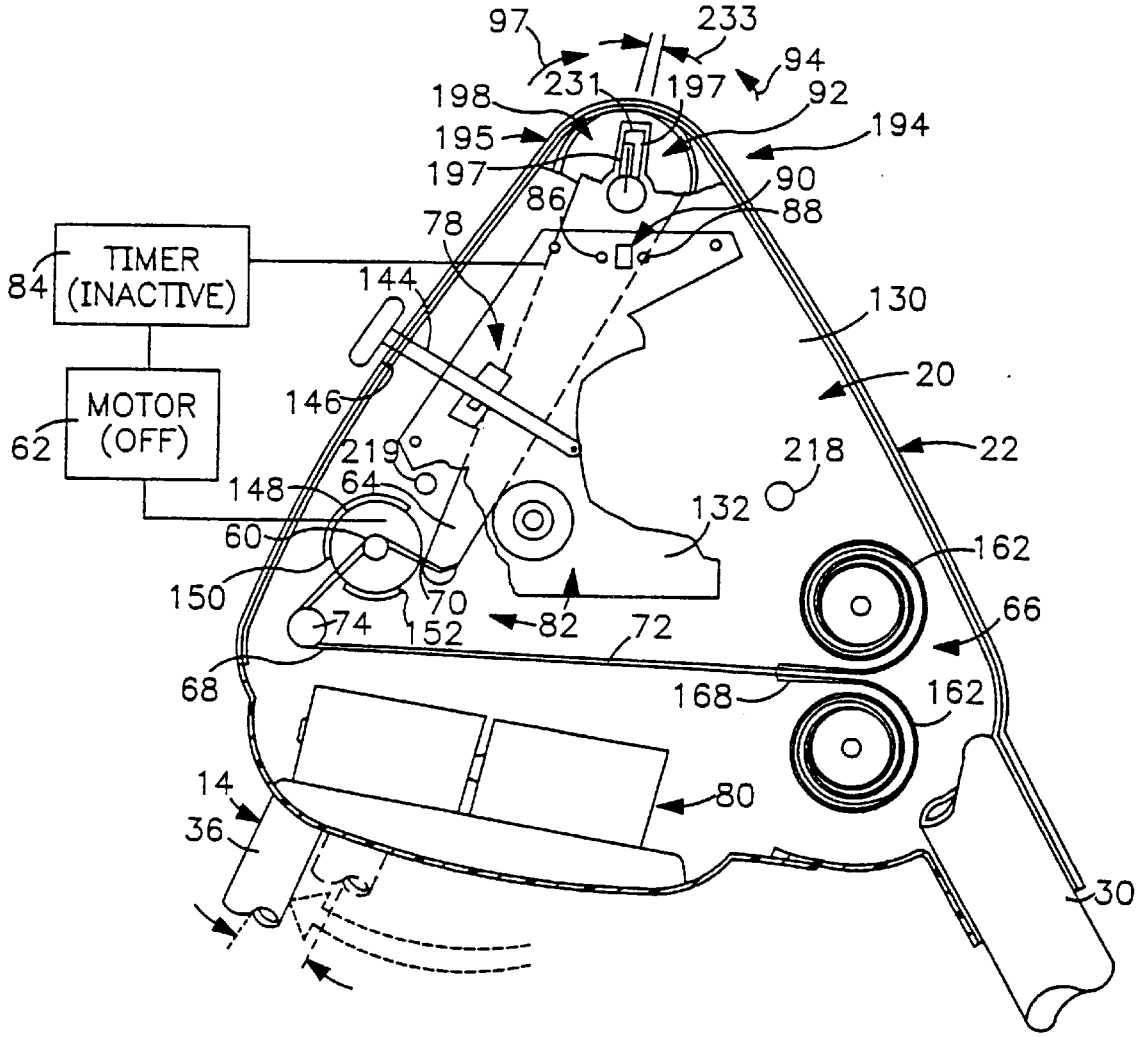
FIG. 16 is a view similar to FIG. 15 showing that when the drive lever has moved to engage a stop positioned adjacent to the motor the lost motion in the hanger mount has allowed the seat frame to advance forward without further rotation of the drive shaft appended to the drive lever.

Seat-motion limiter 92 includes drive pin 197 and lost-motion drive socket 198 and is provided to limit motion transmission from drive shaft 48 to hanger mount 195 (and swing seat frame 14) during certain overrun conditions. For example, if swing arc control 82 is set to establish a maximum swing arc (as shown in FIG. 5) and there is little or no mass in seat 18, drive lever 64 will bottom out against mechanical stops 218, 219 shown in FIGS. 6, 15, and 16 as it pivots back and forth about axis of rotation 16. In such a case, if hanger mount 195 was unyieldingly keyed to drive shaft 48, there would be an abrupt interruption in the natural swing arc of swing seat frame 14 and seat 18. To avoid this condition, hanger mount 195 is configured to include a lost-motion drive socket 198 that is designed to "slip" on drive shaft 48 at bearing surface 232 on drive portion 180 due to a lost-motion connection between drive socket 198 and drive pin 197 as shown in FIGS. 14 and 16. Hanger mount 195 (and the swing seat frame 14 and seat 18 appended to hanger mount 195) is allowed to move (swing) forward in direction 97 without further rotation of drive shaft 48 about axis of rotation 16 even after engagement of mechanical stop 219 and the drive lever 64 that is keyed to swing seat frame 14 to rotate therewith. This motion shows the lost-motion connection in action. The lost-motion angle 233 in seat-motion limiter 92 between drive pin 197 and drive socket 198 is about 5° as shown, for example, in FIG. 16.

Hanger mount 195 is molded of polypropylene to help control friction at bearing surface 232 and for wear-resistance. Hanger mount 195 is configured to reposition itself (float) relative to support stand 12 in case of shaft misalignment between the drive shaft 48 attached to the right side of swing seat frame 14 and the auxiliary shaft 52 (FIG. 2) attached to the left side of swing seat frame 14 (clearance between hanger mount and shaft is 0.010 inch (0.025 cm) on radius). Gap 234 between hanger mount 195 and drive shaft 48 shown in FIG. 14 assures that hanger mount 195 will not wobble excessively during shipping or any time prior to attaching seat 18 to swing seat frame 14. End cap 193 includes a cylindrical cup 101 that has an interior region receiving the free end of retaining portion 180 of drive shaft 48 as shown in FIG. 14. The friction at bearing surface 232 helps to decay an overrunning swing arc to help cushion any abrupt stop. In an alternative embodiment (not shown), an electronic limit switch could limit motion transmission to the swing seat frame 14. On the return stroke of swing seat frame 14 in direction 94, drive socket 198 of hanger mount 195 again engages drive pin 197 of drive shaft 48 at point 231 and resets everything to normal. Drive shaft 48 then rotates with hanger mount 195 and the cycle begins again.

Figure 17:
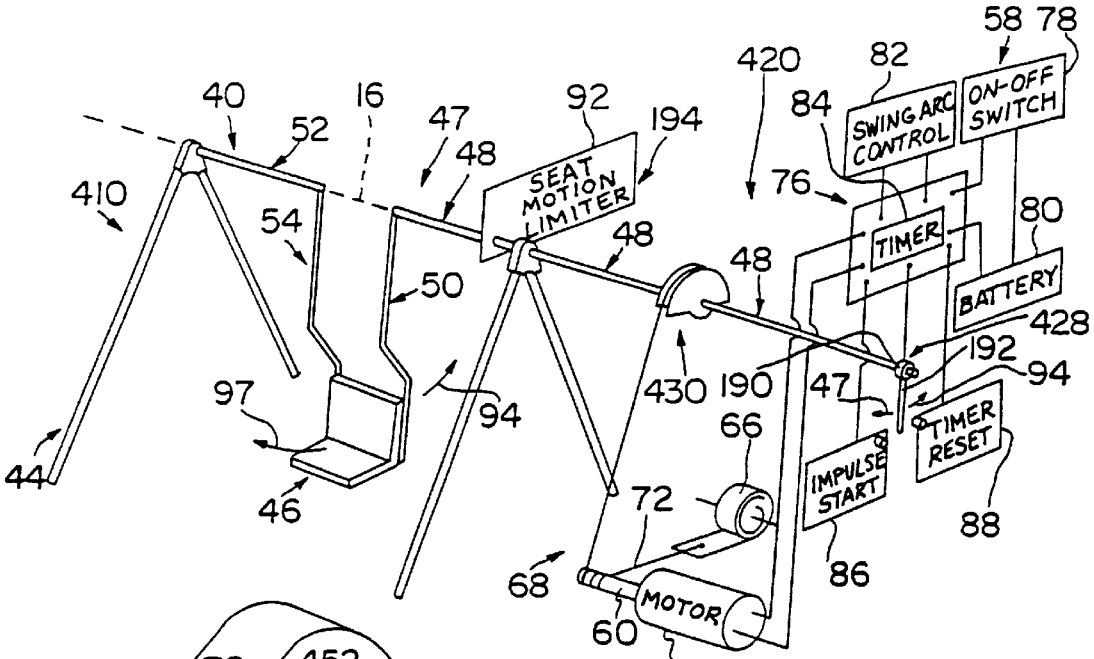
FIG. 17 is a schematic view similar to FIG. 2 of a pendulum-drive apparatus in accordance with another embodiment of the present invention and showing a semi-circular pendulum driver coupled to a monofilament drive line.
Figure 18:
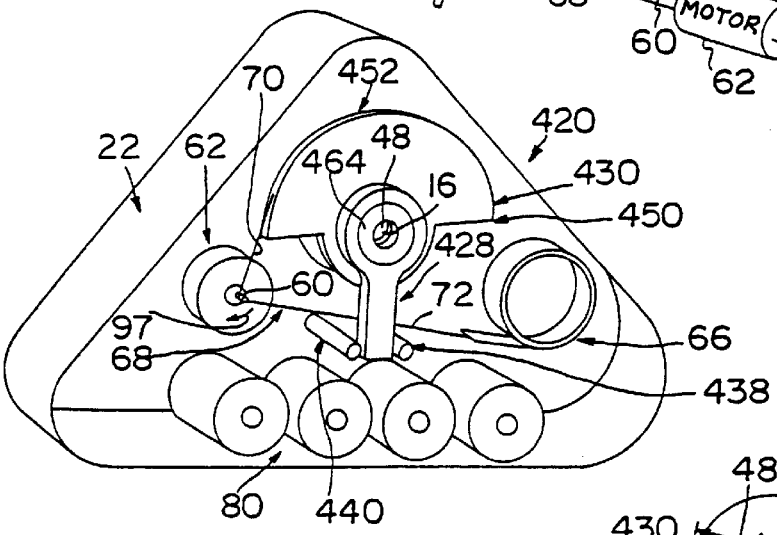
FIG. 18 is a perspective view of a portion of the automatic pendulum-drive apparatus shown in FIG. 17.
Figure 19:
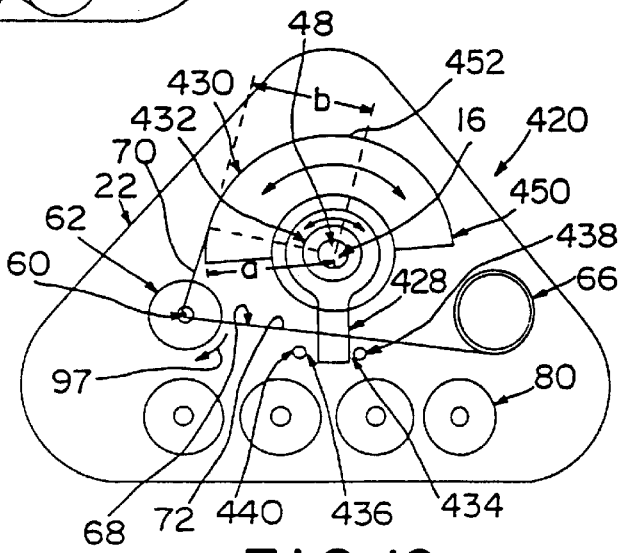
FIG. 19 is a side elevation view of the apparatus shown in FIG. 18 showing a slip switch in a timer reset position.

Another embodiment of a pendulum-drive system 420 in accordance with the present invention is shown in FIGS. 17–19. Pendulum-drive apparatus 420 is shown schematically in FIG. 17 and a portion of pendulum-drive apparatus 420 is shown in FIGS. 18 and 19. Essentially, pendulum-drive apparatus 420 includes pendulum driver 430 instead of the drive lever 64 described in connection with the previous embodiment.

As shown in FIG. 17, swing 410 includes support stand 44 and a swing seat frame 47 including first and second hanger arms 50, 54 carrying seat 46. A housing 22 is mounted on support stand 46 and contains pendulum-drive apparatus 420 therein. Pendulum-drive apparatus 420 is configured to periodically apply a torque to hanger arm 50 of swing seat frame 47 to sustain swinging movement of swing seat frame 47 about axis of rotation 16.

Pendulum-drive apparatus 420 includes the following:

(1) point 16 is the central axis of rotation of the swing seat frame 47, upon which slip switch 428 and pendulum driver 430 rotate about;

(2) bearing interface 432 is a low-friction slip-fit between slip switch 428 and pendulum driver 430;

(3) points 434, 436 are electrical contact points between slip switch 428 and contact posts 438, 440; and (4) line-tensioning spring 66 is a low-friction constant force (negator) spring and spring 66 has a prewind of approximately two-inch extension.

Drive line 68 is a monofilament plastic line, steel, urethane, or any other flexible type material that is connected to pendulum driver 430 at point 450 and engages semicircular edge 452 of pendulum driver 430. The circular design of pendulum driver 430 is used instead of lever arm 64 shown in FIGS. 2 and 6 so that the ratio between pendulum driver 30 and motor shaft 60 remains constant. As shown in FIG. 19, dimension "a" equals dimension "b" so that the ratio of a to b remains the same wherever the pendulum driver 430 is pulled from and the pulling force applied to drive line 68 remains constant.

When motor 62 is turned on by a motor timer 84 and shaft 60 begins to rotate in direction 97, pendulum driver 430 is rotated in direction 97 since it is pulled by drive line 68 wound around the motor shaft 62. Main shaft 48 is keyed to pendulum driver 430 and also rotates in direction 97. (Seat hanger system and seat are attached to main shaft 60.) The relationship of the motor shaft 60 diameter and the diameter of pendulum driver 430 gives a mechanical advantage of approximately 50:1. The surface speed of motor shaft 60 must be capable of being greater than the surface speed of pendulum driver 430, therefore always maintaining a pulling force on pendulum driver 430 when the motor 62 is on. Surface speed of pendulum driver 430 is determined by the natural frequency (period) of the pendulum 46, 50, 54 pivoting about axis 16. The mass of the hanger system 50, 54, seat 46, and mass in the seat (child) (not shown) will be referred to as the "pendulum." The period is determined by the distance from axis 16 to the center of gravity of the seat 46, 50, 54, the mass placed in the swing seat 46, and the gravitational pull on the mass. For ease of description, friction of moving parts and air resistance is ignored at this time.

Slip switch 428 begins to rotate about axis 16 with pendulum driver 430. Slip switch 428 is mounted onto the hub 464 of pendulum driver 430 with a slip-fit. The friction (determined by the choice of materials of slip switch 428 and pendulum driver 430) and the weight of slip switch 428 at bearing interface 432 causes slip switch 428 to rotate with pendulum driver 430. The slip switch 428 must have very low friction due to the small force used to drive the pendulum and to conserve power consumption. This low friction is unique in that other conventional systems are not concerned as much with power consumption.

When slip switch 428 comes in contact with impulse-start contact post 438 (as shown in FIG. 19), rotation of slip switch 428 stops. Pendulum driver 430 can continue to rotate due to the slip-fit between slip switch 428 and pendulum driver 430. This is one of the key features of operation. When the timer 84 shuts off, the motor 62 is turned off, but pendulum driver 430 continues to rotate within its full swing arc due to the inertia of the mass of the pendulum which is attached to drive shaft 60. The swing arc angle may vary, but the slip switch 428 is not sensitive to this change. Since the arc angle can vary, a fixed means of sensing is not an effective way to determine the position of the pendulum. When the pendulum reaches its greatest forward arc position, it stops, and then begins is opposite rotation due to the gravitational attraction on the pendulum. Slip switch 428 begins to rotate again with pendulum driver 430. It should now be apparent that no matter what the arc angle is, slip switch 428 does not begin its return until pendulum driver 430 begins its return.

When placing a mass (child)in the seat 46, the center of gravity can vary, causing a change in the position of the center of the pendulum arc. This is one of the things that other systems are unable to sense effectively since the mass (child) centers vary. Also, if the child leans forward or backward in the seat, this greatly changes the center of gravity, repositioning the center of the arc. This repositioning of the center of the arc and variations of arc angle are what other systems cannot sense. The uniqueness of the new slip switch 428 design is that it does not care where the center of gravity is because its motion is determined by the natural pendulum arc.

It is also important to understand the function of the motor 62 with the slip switch 28. Whenever the motor 62 is actuated, it pulls on the drive line 68. Since the motor 62 has almost the same torque at any position of the armature, it can be started at any position of the pendulum and deliver the same amount of force to the pendulum. This is one of the advantages over conventional solenoid-type operation. The motor shaft 60 turns many times (approximately 50 times more than the pendulum) even when it is not powered, being rotated by the motion of the pendulum. Therefore, the armature of motor 62 can be in any position when called upon to start. If the armature was sensitive to position, it would be very difficult to be actuated at the precise moment the pendulum begins its return. This is another key factor that makes this unit unique. Competitor units are gear-driven continuously and cannot "pick up on" the natural frequency of the pendulum to start the motor 62. The slip switch 428 and motor 62 combination accomplishes what other conventional units have been unable to do.

Yet another embodiment of a pendulum-drive system 510 in accordance with the present invention is shown in FIG. 20. Pendulum-drive system 510 is well-suited for use in the embodiment shown, for example, in FIGS. 1 and 2. Essentially, pendulum-drive system 510 is more compact in size than other embodiments disclosed herein because of a line-control system 511 for controlling location and movement of a drive line 512 coupled to drive lever 514, motor shaft 516 of electric motor 518, and line-tensioning spring 520. Illustratively, line-control system 511 includes a pair of anchor posts 522, 524 adjacent to motor shaft 516, one pulley 526 mounted on drive lever 514, and another pulley 528 mounted on line-tensioning spring 520.

Pendulum-drive system 510 includes a compact housing 529 mounted on a support leg 530 included in a support stand 532 similar to stand 30 shown in FIG. 1. Compact housing 529 would be used in place of housing 22 shown in the embodiment of FIG. 1 to contain various components included in pendulum-drive system 510.

Pendulum-drive system 510 also includes a battery pack 534 including four D cells 536, a circuit board 538 carrying a electrical circuit 540 including a timer 542, a swing arc control 544, and an on-off switch 546. One suitable circuit is described in connection with the embodiment of FIG. 1 and disclosed in FIG. 13.

A slip switch 548 is included in pendulum-drive system 510 and mounted on a drive shaft 550 arranged to extend into compact housing 529 and connect to right-side hanger arm 552. Drive shaft 550 is rotatable about axis 554. Slip switch 548 is movable to engage impulse-start contact 556 and timer-reset contact 558 during swinging movement of hanger arm 552. Slip switch 548 operates in the same manner as slip switch 90 (described above) so that, in use, electrical engagement of slip switch 548 and impulse-start contact 556 starts motor timer 542 which in turn starts electric motor 518. Then, power to the electric motor 518 is turned off by motor timer 542 during swinging movement of hanger arm 552 in one direction. Then motor timer 542 is reset due to electrical engagement of slip switch 548 and timer-reset contact 558 during swinging movement of hanger arm 552 in an opposite direction. As was the case in the embodiment of FIGS. 1 and 2, motor 518 is preferably actuated and allowed to run for a predetermined time interval to apply an angular impulse to the swing seat frame and seat once during each swing cycle.

Drive lever 514 includes a base end 560 coupled to drive shaft 550 and a free end 562 carrying pulley 526. Line-tensioning spring 520 is illustratively a single constant-force (negator) spring mounted on a bearing 5464 fixed to a panel 566 included in compact housing 529. Spring 520 includes a free end 568 carrying pulley 528.

Drive line 512 includes one end 570 coupled to first anchor post 522 (mounted on panel 566) and another end 572 coupled to second anchor post 524 (mounted on panel 566). Drive line 512 also includes a middle portion that is wrapped around pulley 526 on drive lever 514, motor shaft 516, and pulley 528 on line-tensioning spring 520 as shown in FIG. 20. Drive lever 514 is able to pivot from one extreme position (shown in phantom lines) wherein pulley 526 is close to drive shaft 516 to another extreme position (also shown in phantom lines) wherein pulley 526 is far away from drive shaft 516. In use, drive lever 514 pivots about axis 554 due to force applied by drive line 512 during rotation of motor shaft 516.

In the embodiment of FIG. 20, a high torque is generated in a small package. By attaching the drive line 512 to post 522 and over pulley 526, a 2:1 ratio is established as twice as much line is used. Pulley 528 is coupled to line-tensioning spring 520 to use up extra line with a 1:2 ratio (otherwise the spring would extend twice as far requiring a larger size housing). This arrangement causes the spring force to be divided by two.

In yet another embodiment, a voice-activation system is added to circuit 76 in addition to on-off switch 78. Voice-activation system provides means for detecting sound emanating from a child seated in the swing or a nearby caregiver and using that sound to trigger motor 62 and motor timer 84 to generate an angular impulse so that the angular impulse is transmitted to swing seat frame 14. In use, if a sleeping child seated in seat 18 awakes while seat 18 is in its equilibrium position 100 and begins to cry, the voice-activation system will detect such crying using a microphone mounted on swing 10 and instruct motor 62 and motor timer 84 to generate an angular impulse so as to start swinging movement of seat 18. If the awakened child moves about while in seat 18 after just awakening so as to begin a small swing arc of the type shown in FIG. 3, crying can cause the voice-activation system to generate an angular impulse effective to sustain such swinging movement of seat 18.

Although the invention has been described in detail with reference to certain preferred embodiments, variations and modifications exist within the scope and spirit of the invention as described and defined in the following claims.

We claim:

1. A swing comprising a support stand, a swing seat frame mounted on the support stand to swing freely back and forth along a swing arc about an axis of rotation so that the swing seat frame is displaced angularly in a first swing direction to a first extreme position and then displaced angularly in a second swing direction to a second extreme position during each cycle of swinging movement of the swing seat frame along the swing arc, impulse means for applying a torque to the swing seat frame for a predetermined time interval so that the swing seat frame is subjected to an angular impulse as it swings along the swing arc to sustain swinging movement of the swing frame back and forth along the swing arc, and means for actuating the impulse means at an actuation position of the swing seat frame located along the swing arc and between the first and second extreme positions that is not fixed relative to the support stand following free-swinging movement of the swing seat frame in the second swing direction from the first extreme position toward the second extreme position and to the actuation position so that said torque is applied to the swing seat frame for said predetermined time interval during swinging movement of the swing seat frame from the actuation position toward the second extreme position.

2. The swing of claim 1, wherein the actuating means includes means for establishing the actuation position at a variable point along the swing arc defined by sweeping movement of the swing seat frame along the swing arc from the first extreme position through a predetermined angle along the swing arc to said variable point so that the actuation position is located along the swing arc in a fixed angular relation to the first extreme position to cause the impulse means to be actuated in response to certain angular displacement of the swing seat frame from the first extreme position without regard to the position of the swing seat frame relative to the support stand.

3. The swing of claim 2, wherein the actuating means further includes means coupled to the establishing means for communicating an actuation signal to the impulse means to actuate the impulse means in response to angular movement of the swing seat frame from the first extreme position through the predetermined angle to the actuation position.

4. The swing of claim 3, wherein the swing seat frame includes a drive shaft supported on the support stand for rotation about the axis of rotation and a swing seat coupled to the drive shaft and the establishing means includes an actuation signal generator and an impulse-start switch having a slip ring configured to wrap around the drive shaft and establish a slippable friction fit therewith and a switch arm appended to the slip ring and arranged to move to engage the actuation signal generator to generate the actuation signal in response to movement of the slip ring with the rotating drive shaft during movement of the swing seat frame from the first extreme position through the predetermined angle to the actuation position.

5. The swing of claim 2, wherein the swing seat frame includes a drive shaft supported on the support stand for rotation about the axis of rotation and a swing seat coupled to the drive shaft and the establishing means includes an impulse-start switch having a slip ring configured to wrap around the drive shaft and establish a slippable friction fit therewith and a switch arm appended to the slip arm and arranged to move therewith.

6. The swing of claim 5, wherein the impulse means includes an electric swing motor and a torque-transmission linkage coupled to the electric swing motor and to the drive shaft, the establishing means includes an electrical circuit coupled to the electric swing motor and to the impulse-start switch, the electrical circuit includes an impulse-start contact arranged to engage the switch arm in response to movement of the slip ring with the rotating drive shaft during angular movement of the swing seat frame from the first extreme position through the predetermined angle to the actuation position.

7. The swing of claim 5, wherein the impulse means includes a housing containing the actuating means, a drive lever coupled to the drive shaft to rotate therewith and positioned to lie inside the housing in close proximity to the slip ring and a linkage configured to rotate the drive lever about the axis of rotation in response to movement of the slip ring with the rotating drive shaft during movement of the swing seat frame from the first extreme position to the actuation position.

8. The swing of claim 1, wherein the impulse means includes an electric swing motor coupled to the actuating means and configured to have a motor-on condition and a motor-off condition, a motor shaft moved by the electric swing motor, a torque-transmission linkage coupled to the motor shaft and to the swing seat frame and configured to apply said torque to the swing seat frame about the axis of rotation in response to a signal provided by the actuating means switching the electric swing motor to the motor-on condition.

9. The swing of claim 8, wherein the impulse means further includes a timer circuit coupled to the electric swing motor and to the actuating means and the timer circuit includes means for switching the electric swing motor to the motor-on condition upon receipt of the signal from the actuating means and for automatically switching the electric swing motor from the motor-on condition to the motor-off condition after elapse of the predetermined time interval so that application of the torque to the swing seat frame by the torque-transmission linkage ceases.

10. The swing of claim 9, wherein the switching means includes means for establishing the actuation position at a variable point along the swing arc defined by sweeping movement of the swing seat frame along the swing arc from the first extreme position through a predetermined angle to said variable point so that the actuation position is located along the swing arc in a fixed angular relation to the first extreme position and means for causing the electric motor to be switched to the motor-on condition in response to predetermined angular displacement of the swing seat frame from the first extreme position to the actuation position without regard to the position of the swing seat frame relative to the support stand.

11. The swing of claim 8, wherein the swing seat frame includes a drive shaft supported on the support stand for rotation about the axis of rotation and a swing seat coupled to the drive shaft and the torque-transmission linkage includes a drive lever coupled to the drive shaft to rotate therewith and a drive line coupled to the motor shaft and the drive lever.

12. The child swing of claim 11, wherein the torque-transmission linkage further includes a constant-force spring and the drive line includes a first end coupled to the drive lever, a second end coupled to the constant force spring, and a middle portion lying between the first and second ends and engaging the motor shaft.

13. The swing of claim 1, wherein the impulse means includes a drive shaft supported on the support stand for rotation about the axis of rotation and coupled to the swing seat frame and the actuating means includes an impulse-start switch coupled to the drive shaft to rotate therewith.

14. The swing of claim 13, wherein the impulse means includes an electric swing motor having a motor-on condition and a motor-off condition, an impulse-start contact electrically coupled to the electric swing motor and positioned to engage the impulse-start switch during swinging movement of the swing seat frame along the swing arc from the first extreme position to the second extreme position after the swing seat frame has swung from the first extreme position through a predetermined angle to the actuation position without regard to the position of the swing seat frame relative to the support stand and means for electrically coupling the impulse-start switch to the electric swing motor so that the electric swing motor is switched to the motor-on condition to generate the torque in response to engagement of the impulse-start switch and the impulse-start contact.

15. The swing of claim 14, wherein the impulse means further includes timer means for allowing the electric swing motor to remain in the motor-on condition for the predetermined time interval during swinging movement of the swing seat frame along the swing arc toward the second extreme position and then switching the electric swing motor to the motor-off condition before the swing seat frame reaches the second extreme position so that the swing seat frame swings freely to the second extreme position.

16. The swing of claim 15, wherein the timer means includes a resettable clock for defining the predetermined time interval, a clock-reset contact electrically coupled to the resettable clock and positioned to engage the impulse-start switch during swinging movement of the swing seat frame along the swing arc from the second extreme position to the first extreme position, and means for resetting the clock during swinging movement of the swing seat frame along the swing arc from the second extreme position toward the first extreme position in response to engagement of the impulse-start switch and the clock-reset contact so that the timer means is set to allow the electric swing motor to remain in the motor-on condition for the predetermined time interval upon subsequent engagement of the impulse-start switch and the impulse-start contact during swinging movement of the swing seat frame along the swing arc.

17. The swing of claim 13, wherein the impulse-start switch includes a slip ring configured to wrap around the drive shaft and establish a slippable friction fit therewith and a switch arm appended to the slip ring and the impulse means includes an impulse-start contact positioned to engage the switch arm during swinging movement of the swing seat frame along the swing arc from the first extreme position to the second extreme position after the swing seat frame has swung from the first extreme position through a predetermined angle to the actuation position without regard to the position of the swing seat frame relative to the support stand, a swing motor configured to generate the torque, a torque-transmission linkage coupled to the swing motor and to the swing seat frame to apply said torque to the swing seat frame about the axis of rotation, and means for instructing the swing motor to generate said torque to operate the torque-transmission linkage to apply said torque to the swing seat frame in response to engagement of the switch arm and the impulse-start contact.

18. The swing of claim 1, wherein the impulse means includes a drive shaft supported on the support stand for rotation about the axis of rotation and coupled to the swing seat frame and an electric swing motor and the actuating means includes an impulse-start switch coupled to the drive shaft to rotate therewith and signal means for delivering an electrical actuation signal to actuate the electric swing motor upon rotational movement of the drive shaft and the impulse-start switch coupled to the drive shaft through a predetermined angle of rotation.

19. The swing of claim 18, wherein the impulse-start switch includes a slip ring configured to wrap around the drive shaft and establish a slippable friction fit therewith and a switch arm appended to the slip ring and arranged to pivot about the axis of rotation during frictional engagement of the slip ring and the drive shaft.

20. The swing of claim 18, wherein the signal means includes an electrical circuit coupled to the electric swing motor, a power supply coupled to the electrical circuit, and an impulse-start contact coupled to the electrical circuit and the impulse-start switch includes a slip ring configured to wrap around the drive shaft and establish a slippable friction fit therewith and a switch arm appended to the slip ring and coupled to the electrical circuit and movable to engage the impulse-start contact during swinging movement of the swing seat frame along the swing arc from the first extreme position through said predetermined angle of rotation to the actuation position to generate the electrical actuation signal and cause the electrical actuation signal to be delivered through the electrical circuit to the electric swing motor.

21. A swing comprising a support stand, a timer mechanism, a swing seat frame mounted on the support stand to swing freely back and forth along a swing arc about an axis of rotation in a first swing direction and an opposite second swing direction, and means coupled to the swing seat frame for applying a torque to the swing seat frame for a predetermined time interval set by the timer mechanism so that the swing seat frame is subjected to an angular impulse as it swings along the swing arc to sustain swinging movement of the swing seat frame back and forth along the swing arc.

22. A swing comprising a support stand, a swing seat frame mounted on the support stand to swing freely back and forth along a swing arc about an axis of rotation in a first swing direction and an opposite second swing direction, and impulse means coupled to the swing seat frame for applying a torque to the swing seat frame for a predetermined time interval so that the swing seat frame is subjected to an angular impulse as it swings along the swing arc to sustain swinging movement of the swing seat frame back and forth along the swing arc, the impulse means including an impulse-start switch coupled to the swing seat frame for movement therewith, an electric swing motor having a motor-on condition and a motor-off condition, an impulse-start contact electrically coupled to the electric swing motor and positioned to engage the impulse-start switch during swinging movement of the swing seat frame along the swing arc, and means for electrically coupling the impulse-start switch to the electric swing motor so that the electric swing motor is switched to the motor-on condition to generate the torque in response to engagement of the impulse-start switch and the impulse-start contact.

23. The swing of claim 22, wherein the impulse means further includes timer means for allowing the electric swing motor to remain in the motor-on condition for the predetermined time interval during swinging movement of the swing seat frame in a first direction along the swing arc.

24. The swing of claim 23, wherein the timer means includes a resettable clock for defining the predetermined time interval, a clock-reset contact electrically coupled to the resettable clock and positioned to engage the impulse-start switch during swinging movement of the swing seat frame along the swing arc in a second direction opposite to the first direction, and means for resetting the clock during swinging movement of the swing seat frame along the swing arc in the second direction in response to engagement of the impulse-start switch and the clock-reset contact so that the timer means is set to allow the electric swing motor to remain in the motor-on condition for the predetermined time interval upon subsequent engagement of the impulse-start switch and the impulse-start contact during swinging movement of the swing seat frame along the swing arc in the first direction.

25. A swing comprising a support stand, a swing seat frame mounted on the support stand to swing freely back and forth along a swing arc about an axis of rotation in a first swing direction and an opposite second swing direction, and impulse means coupled to the swing seat frame for applying a torque to the swing seat frame for a predetermined time interval so that the swing seat frame is subjected to an angular impulse as it swings along the swing arc to sustain swinging movement of the swing seat frame back and forth along the swing arc, the impulse means including an electric swing motor having a motor shaft, a torque-transmission linkage coupled to the motor shaft of the electric swing motor and to the swing seat frame and configured to apply a torque to the swing seat frame about the axis of rotation in response to energization of the electric swing motor to move the motor shaft, and a timer circuit configured to energize the electric swing motor periodically for the predetermined time interval to generate said angular impulse.

26. The child swing of claim 25, wherein the swing seat frame includes a drive shaft supported on the support stand for rotation about the axis of rotation and the torque-transmission linkage includes a drive lever coupled to the drive shaft to rotate therewith and a drive line coupled to the motor shaft and the drive lever.

27. The child swing of claim 26, wherein the torque-transmission linkage further includes a constant-force spring and the drive line includes a first end coupled to the drive lever, a second end coupled to the constant-force spring, and a middle portion lying between the first and second ends and engaging the motor shaft.

28. A swing comprising a support stand, a swing seat frame mounted on the support stand to swing freely back and forth along a swing arc about an axis of rotation in a first swing direction to a first extreme position and an opposite swing direction to a second extreme position during each cycle of swinging movement of the swing seat frame along the swing arc, torque drive means for applying a torque to the swing seat frame as it swings along the swing arc, the torque drive means including an electric swing motor startable to generate the torque, and timer means for starting and then stopping the electric swing motor only once during each swing cycle to cause the swing motor to generate the torque only for a predetermined time interval during movement of the swing seat frame along the swing arc between the first and second extreme positions, which predetermined time interval is less than the interval of time required for the swing seat to swing in one of the swing directions between the first and second extreme positions during swinging movement of the swing seat frame in one of the first and second swing directions along the swing arc.

29. A swing comprising a support stand, a swing seat frame mounted on the support stand to swing freely back and forth along a swing arc about an axis of rotation in a first swing direction to a first extreme position and an opposite swing direction to a second extreme position during each cycle of swinging movement of the swing seat frame along the swing arc, torque drive means for applying a torque to the swing seat frame as it swings along the swing arc, the torque drive means including a swing motor startable to generate the torque, and motor control means for periodically supplying power to and then stopping the supply of power to the swing motor to cause the swing motor to generate the torque only for a predetermined time interval, which predetermined time interval is less than the interval of time required for the swing seat to swing in one of the swing directions between the first and second extreme positions during swinging movement of the swing seat frame in one of the first and second swing directions along the swing arc.

30. The swing of claim 29, wherein the motor control means includes means for establishing an actuation position of the swing seat frame at a variable point along the swing arc defined by sweeping movement of the swing seat frame along the swing arc from the first extreme position through a predetermined angle to said variable point so that the actuation position is located along the swing arc in a fixed angular relation to the first extreme position and motor-start means for causing the swing motor to be started in response to predetermined angular displacement of the swing seat frame from the first extreme position to the actuation position without regard to the position of the swing seat frame relative to the support stand.

31. The swing of claim 30, wherein the motor control means further includes motor stop means for stopping the supply of power to the swing motor at the end of the predetermined time interval and during swinging movement of the swing seat frame along the swing arc between the actuation position and the second extreme position.

32. The swing of claim 29, wherein the swing motor includes an electric drive unit coupled to the timer circuit means and a motor shaft moved by the electric drive unit.

33. The swing of claim 32, wherein the torque drive means further includes a torque-transmission linkage coupled to the motor shaft and to the swing seat frame and configured to apply said torque to the swing seat frame only during the predetermined time interval.

34. The swing of claim 33, wherein the swing seat frame includes a drive shaft supported on the support stand for rotation about the axis of rotation and a swing seat coupled to the drive shaft and the torque-transmission linkage includes a drive lever coupled to the drive shaft to rotate therewith and a drive line coupled to the motor shaft and the drive lever.

35. The swing of claim 32, wherein the swing seat frame includes a drive shaft supported to the support stand for rotation about the axis of rotation and a swing seat coupled to the drive shaft and the motor control means includes circuit means for providing electric current to the electric drive unit and a motor-start switch coupled to the drive shaft and the circuit means.

36. The swing of claim 35, wherein the circuit means includes a timer having a clock set to define the predetermined time interval, a motor-start contact coupled to the clock, a timer-reset contact coupled to the clock, and a power supply, the motor-start switch includes a slip ring mounted on the drive shaft for rotation therewith and a switch arm having one end appended to the slip ring and a free end positioned to move between and engage the timer-reset contact and the motor-start contact included in the circuit means during rotation of the drive shaft, and the circuit means further includes means for using the clock to couple the power supply to the electric drive unit for the predetermined time interval in response to engagement of the switch arm and the motor-start contact.

37. The swing of claim 36, wherein the circuit means further includes means for resetting the clock in response to engagement of the switch arm and the timer-reset contact.

38. The swing of claim 29, wherein the motor control means includes a clock set to define the predetermined time interval, switch means for starting the swing motor and the clock upon movement of the swing seat frame to a motor-start position along the swing arc between the first and second extreme positions so that the swing seat frame is subjected to an angular impulse as it swings along the swing arc following free-swinging movement of the swing seat frame along the swing arc between the first extreme position and the motor-start position to sustain swinging movement of the swing back and forth along the swing arc, and means for using the clock to stop the swing motor at the end of the predetermined time interval so that the swing seat frame is allowed to swing freely from the position occupied by the swing seat frame when the swing motor is stopped by the using means at least until the swing seat frame reaches the second extreme position.

39. The swing of claim 38, wherein the swing motor includes an electric drive unit and a motor shaft moved by the electric drive unit and the switch means includes a motor-start switch coupled to the drive shaft to rotate therewith and means for providing electricity to the electric drive unit to start the swing motor and move the motor shaft upon rotational movement of the drive shaft and the motor-start switch coupled thereto through a predetermined angle of rotation between the first extreme position and the motor-start position.

40. The swing of claim 39, wherein said predetermined angle of rotation is about 5°.

41. The swing of claim 39, wherein the motor-start switch includes a slip ring configured to wrap around the drive shaft and establish a slippable friction fit therewith and a switch arm appended to the slip ring and movable to intermittently engage and disengage the using means during swinging movement of the swing seat frame along the swing arc.

42. A swing comprising a support stand, a swing seat frame mounted on the support stand to swing freely back and forth along a swing arc about an axis of rotation in a first swing direction and an opposite second swing direction, an electric swing motor having a motor shaft and having a motor-on condition and a motor-off condition, an impulse-start contact mounted in a fixed position on the support stand and electrically coupled to the electric swing motor, an impulse-start switch coupled to the swing seat frame for movement therewith and positioned to engage the impulse-start contact during swinging movement of the swing seat frame along the swing arc, a motor circuit electrically coupling the impulse-start switch to the electric swing motor so that the electric swing motor is switched to the motor-on condition to rotate the motor shaft to generate a torque about the axis of rotation in response to engagement of the impulse-start switch and the impulse-start contact, a torque-transmission linkage coupled to the motor shaft of the electric swing motor and to the swing seat frame and configured to apply the torque to the swing seat frame about the axis of rotation in response to switching of the electric swing motor to the motor-on condition, and a timer circuit coupled to the motor circuit and configured to allow the electric swing motor to remain in the motor-on condition for a predetermined time interval during swinging movement of the swing seat frame in a first direction along the swing arc to move the motor shaft so that the swing seat frame is subjected to an angular impulse as it swings along the swing arc in the first direction to sustain swinging movement of the swing seat frame back and forth along the swing arc.

43. The swing of claim 42, wherein the timer circuit includes a resettable clock for defining the predetermined time interval.

44. The swing of claim 43, wherein the timer circuit further includes a clock-reset contact electrically coupled to the resettable clock and positioned to engage the impulse-start switch during swinging movement of the swing seat frame along the swing arc in a second direction opposite to the first direction and a reset mechanism resetting the clock during swinging movement of the swing seat frame along the swing arc in the second direction in response to engagement of the impulse-start switch and the clock-reset contact so that the timer means is set to allow the electric swing motor to remain in the motor-on condition for the predetermined time interval upon subsequent engagement of the impulse-start switch and the impulse-start contact during swinging movement of the swing seat frame along the swing arc in the first direction.

45. The swing of claim 44, wherein the clock-reset contact is mounted in a fixed position in spaced-apart relation to the impulse-start contact.

46. The swing of claim 44, wherein the clock-reset contact is mounted in a fixed position on the support stand.

47. The child swing of claim 42, wherein the swing seat frame includes a drive shaft supported on the support stand for rotation about the axis of rotation and the torque-transmission linkage includes a drive lever coupled to the drive shaft to rotate therewith and a drive line coupled to the motor shaft and the drive lever.

48. The child swing of claim 47, wherein the torque-transmission linkage further includes a constant-force spring and the drive line includes a first end coupled to the drive lever, a second end coupled to the constant-force spring, and a middle portion lying between the first and second ends and engaging the motor shaft.

49. The swing of claim 42, wherein the swing seat frame includes a drive shaft supported on the support stand for rotation about the axis of rotation and a swing seat coupled to the drive shaft, the swing seat frame is arranged on the support stand to swing freely back and forth along the swing arc about the axis of rotation so that the swing seat frame is displaced angularly in the first swing direction to a first extreme position and then displaced angularly in the second swing direction to a second extreme position during each cycle of swinging movement of the swing seat frame along the swing arc, the impulse-start switch has a slip ring configured to wrap around the drive shaft and establish a slippable friction fit therewith and a switch arm appended to the slip ring and arranged to move to engage the impulse-start contact to generate an actuation signal in response to movement of the slip ring with the rotating drive shaft following free-swinging movement of the swing seat frame in the second swing direction from the first extreme position toward the second extreme position and to an actuation position located along the swing arc and between the first and second extreme positions that is not fixed relative to the support stand so that said torque is applied to the swing seat frame for said predetermined time interval during swinging movement of the swing seat frame from the actuation position toward the second extreme position.

50. The swing of claim 49, wherein the impulse-start switch is positioned to establish the actuation position at a variable point along the swing arc defined by sweeping movement of the swing seat frame along the swing arc from the first extreme position through a predetermined angle to said variable point so that the actuation position is located along the swing arc in a fixed angular relation to the first extreme position and to cause the electric motor to be switched to the motor-on condition in response to predetermined angular displacement of the swing seat frame from the first extreme position to the actuation position without regard to the position of the swing seat frame relative to the support stand.

51. The swing of claim 42, wherein the swing seat frame includes a drive shaft supported on the support stand for rotation about the axis of rotation and a swing seat coupled to the drive shaft and the impulse-start switch includes a slip ring configured to wrap around the drive shaft and establish a slippable friction fit therewith and a switch arm appended to the slip arm and arranged to move therewith.

52. The swing of claim 51, wherein the impulse-start contact is arranged to engage the switch arm in response to movement of the slip ring with the rotating drive shaft during angular movement of the swing seat frame from the first extreme position through the predetermined angle to the actuation position.

53. The swing of claim 42, wherein the swing seat frame includes a drive shaft supported on the support stand for rotation about the axis of rotation and a swing seat coupled to the drive shaft and the torque-transmission linkage includes a drive lever coupled to the drive shaft to rotate therewith and a drive line coupled to the motor shaft and the drive lever.

54. The child swing of claim 53, wherein the torque-transmission linkage further includes a constant-force spring and the drive line includes a first end coupled to the drive lever, a second end coupled to the constant force spring, and a middle portion lying between the first and second ends and engaging the motor shaft.

55. The swing of claim 42, wherein the swing seat frame includes a drive shaft supported on the support stand for rotation about the axis of rotation, the start switch includes a slip ring configured to wrap around the drive shaft and establish a slippable friction fit therewith and a switch arm appended to the slip ring, and the impulse-start contact is positioned to engage the switch arm during swinging movement of the swing seat frame along the swing arc from the first extreme position to the second extreme position after the swing seat frame has swung from the first extreme position through a predetermined angle to an actuation position without regard to the position of the swing seat frame relative to the support stand.

56. A swing comprising a support stand, a swing seat frame mounted on the support stand to swing along a swing arc about an axis of rotation between spaced-apart first and second extreme positions, and a mechanism coupled to the swing seat frame, the mechanism including a torque-producing system and first and second contacts, the swing seat frame being configured to link to the first contact in one of the first and second extreme positions and link to the second contact when the swing seat frame is spaced apart from the first and second extreme positions, the torque-producing system initiating application of a swing force to the swing seat frame when the swing seat frame links to the second contact.

57. A swing comprising a support stand, a swing seat frame mounted on the support stand to swing along a swing arc about an axis of rotation between spaced-apart first and second extreme positions, and a mechanism coupled to the swing seat frame, the mechanism including a torque-producing system and an actuator system, the actuator system activating the torque-producing system to initiate application of a swing force to the swing seat frame when the swing seat frame is spaced apart from the first and second extreme positions.

* * * * *